US005816054A

United States Patent [19]

Yoo et al.

[11] Patent Number: 5,816,054

[45] Date of Patent: Oct. 6, 1998

[54] DEFROSTING APPARATUS FOR REFRIGERATORS AND METHOD FOR CONTROLLING THE SAME

[75] Inventors: Han-Ju Yoo, Kwangmyeong; Jae-Seung Lee, Suwon; Kuk-Jeong Seo, Suwon; Gi-Hyeong Lee, Suwon; Hae-Jin Park, Suwon; Jong-Ki Kim, Suwon, all of Rep. of Korea

[73] Assignee: Samsung Electronics Co., Ltd., Suwon, Rep. of Korea

[21] Appl. No.: 676,246

[22] PCT Filed: Nov. 17, 1995

[86] PCT No.: PCT/KR95/00149

§ 371 Date: Aug. 26, 1996

§ 102(e) Date: Aug. 26, 1996

[87] PCT Pub. No.: WO96/16364

PCT Pub. Date: May 30, 1996

[30] Foreign Application Priority Data

| | | | |
|---|---|---|---|
| Nov. 17, 1994 | [KR] | Rep. of Korea | 1994/30322 |
| Nov. 17, 1994 | [KR] | Rep. of Korea | 1994/30325 |
| Nov. 17, 1994 | [KR] | Rep. of Korea | 1994/30326 |
| Nov. 22, 1994 | [KR] | Rep. of Korea | 1994/30781 |
| Jan. 4, 1995 | [KR] | Rep. of Korea | 1995/39 |
| Jan. 4, 1995 | [KR] | Rep. of Korea | 1995/40 |
| May 31, 1995 | [KR] | Rep. of Korea | 1995/14286 |

[51] Int. Cl.[6] ..... F25B 47/02

[52] U.S. Cl. ..... 62/80; 62/154; 62/155; 62/156

[58] Field of Search ..... 62/80, 81, 151, 62/154, 152, 156, 155, 234

[56] References Cited

U.S. PATENT DOCUMENTS

| | | | |
|---|---|---|---|
| 3,922,874 | 12/1975 | Canter | 62/156 X |
| 4,327,557 | 5/1982 | Clarke et al. | 62/155 X |
| 4,411,139 | 10/1983 | Bos | 62/234 X |
| 4,569,205 | 2/1986 | Dempou et al. | 62/155 |
| 4,750,332 | 6/1988 | Jenski et al. | 62/80 |

*Primary Examiner*—Harry B. Tanner

*Attorney, Agent, or Firm*—Burns, Doane, Swecker & Mathis, L.L.P.

[57] ABSTRACT

A defrosting apparatus for a refrigerator and a method for controlling the defrosting apparatus, wherein the refrigerating compartment is cooled irrespective of the internal temperature of the freezing compartment when the internal temperature of the refrigerating compartment is higher than a predetermined temperature, so that the refrigerating compartment is maintained below the predetermined temperature. The defrosting operation is carried out in accordance with the drive times of the compressor and refrigerating compartment fan when the internal temperature of the refrigerating compartment is higher than the predetermined temperature even though the compressor and refrigerating compartment fan are continuously driven. Accordingly, it is possible to improve the cooling efficiency. For the rapid refrigerating operation, the point of time when the defrosting operation for the refrigerating compartment begins is accurately determined by calculating a temperature drop gradient on the basis of a variation in the internal temperature of the refrigerating compartment. For the rapid freezing operation, the point of time when the defrosting operation for the freezing compartment begins is accurately determined by calculating a temperature drop gradient on the basis of a variation in the internal temperature of the freezing compartment. In either case, accordingly, it is possible to efficiently achieve the defrosting operation.

7 Claims, 15 Drawing Sheets

DEFROSTING APPARATUS FOR REFRIGERATORS AND METHOD FOR CONTROLLING THE SAME

FIELD OF THE INVENTION

The present invention relates to a defrosting apparatus for controlling the defrosting operation of evaporators respectively associated with freezing and refrigerating compartments of a refrigerator and a method for controlling such a defrosting apparatus.

BACKGROUND OF THE INVENTION

An example of such a defrosting apparatus for refrigerators is disclosed in Japanese Utility Model Laid-open publication No. Sho. 56-149859 published on Nov. 10, 1981. The defrosting apparatus disclosed in this publication includes a tank connected in parallel to an. inlet pipe connected between evaporators of the refrigerator, an electromagnetic valve disposed in one conduit extending from the tank, and a timer adapted to cut off the supply of power to a compressor of the refrigerator while applying power to a defrosting heater to open the electromagnetic valve when the operation time of the compressor is accumulated for a certain period of time.

Another defrosting apparatus is disclosed in Japanese Utility Model Laid-open publication No. Sho. 56-1082 published on Jan. 7, 1981. This defrosting apparatus includes electric heaters respectively arranged in the vicinity of a refrigerant inlet port and an evaporator. Above and beneath the evaporator, temperature switches are disposed to control the electric heaters, respectively. The temperature switches have the same temperature set value.

FIG. 1 illustrates a typical refrigerator having a conventional construction whereas FIG. 2 illustrates a refrigerating cycle employed in the refrigerator. As shown in FIG. 1, the refrigerator includes a refrigerator body 1 provided with food storing compartments, namely, a freezing compartment 2 and a refrigerating compartment 3. At the front portion of the refrigerator body 1, doors 2*a* and 3*a* are mounted which serve to open and close the freezing and refrigerating compartments 2 and 3, respectively.

Between the freezing and refrigerating compartments 2 and 3, an evaporator 4 is mounted which carries out a heat exchange between air being blown into the freezing and refrigerating compartments 2 and 3 and refrigerant passing through the evaporator 4, thereby evaporating the refrigerant by latent heat from the air while cooling the air. At the rear side of the evaporator 4, a fan 5*a* is mounted which is rotated by a fan motor 5 to circulate the cold air heat-exchanged by the evaporator 4 through the freezing and refrigerating compartments 2 and 3.

In order to control the amount of cold air supplied to the refrigerating compartment 3, a damper 6 is provided which allows the supply of cold air to the refrigerating chamber 3 or cuts off the supply of cold air in accordance with the internal temperature of the refrigerating compartment 3. A plurality of shelves 7 are separably disposed in both the freezing and refrigerating compartments 2 and 3 to partition the compartments into several food storing sections.

At respective rear portions of the freezing and refrigerating compartments 2 and 3, duct members 8 and 9 are mounted which guide flows of the cold air heat-exchanged by the evaporator 4 such that they enter and circulate through the freezing and refrigerating compartments 2 and 3. The freezing and refrigerating compartments 2 and 3 have cold air discharge ports 8*a* and 9*a*, respectively. Through the cold air discharge ports 8*a* and 9*a*, flows of cold air respectively guided by the duct members 8 and 9 after being heat-exchanged by the evaporator 4 are introduced in the freezing and refrigerating compartments 2 and 3.

A compressor 10 is mounted at the lower portion of the refrigerator body 1 to compress the gaseous refrigerant of low temperature and pressure, emerging from the evaporator 4, to that of high temperature and pressure. A defrosted water dish 11 is also disposed at the front side (the left side when viewed in FIG. 1) of the compressor 10. The defrosted water dish 11 collects water (dewdrop) produced from the air being blown by the fan 5*a* upon cooling the air by the heat exchange at the evaporator 4 and water (defrosted water) produced upon defrosting frost formed at the interior of the refrigerator and drains them out of the refrigerator.

An assistant condenser 12 is disposed beneath the defrosted water dish 11 to evaporate water collected in the defrosted water dish 11. A main condenser 13, which has a zig-zag tube shape, is arranged at both side walls 1*a*. upper wall 1*b* or back wall of the refrigerator body 1. Through the main condenser 13, the gaseous refrigerant of high temperature and pressure passes which has been compressed by the compressor 10. While passing through the main condenser 13, the gaseous refrigerant carries out a heat exchange with ambient air in accordance with the natural or forced convection phenomenon, so that it is forcedly cooled to have a liquid phase under low temperature and high pressure.

At one side of the compressor 10, a capillary tube 14 is mounted. The capillary tube 14 serves to abruptly expand the liquid-phase refrigerant of low temperature and high pressure, which has been liquefied in the main condenser 13, thereby reducing the pressure of the refrigerant to an evaporation pressure. By the capillary tube 14, the refrigerant has low temperature and pressure. Around the front wall of the refrigerator body 1, an anti-dewing pipe 15 is disposed to prevent the formation of dewdrops due to a temperature difference between the ambient warm air and the cold air existing in the refrigerator body 1.

To operate the refrigerator, a user switches on a power switch after setting the desired internal temperatures of the freezing refrigerating compartments 2 and 3. Once the refrigerator is powered, the internal temperature of the freezing compartment 2 is sensed by a temperature sensor installed in the freezing compartment 2. The temperature sensor sends a signal indicative of the sensed temperature to a control unit (not shown) which, in turn, determines whether or not the sensed temperature is more than a predetermined temperature.

When the internal temperature of the freezing compartment 2 is determined as being more than the predetermined temperature, the compressor 10 and fan motor 5 are driven. With the fan motor 5 being driven, the fan 5*a* is rotated.

With the compressor 10 being driven, the refrigerant is compressed in a gaseous phase under high temperature and pressure. This refrigerant is then fed to the assistant condenser 12. While passing through the assistant condenser 12, the refrigerant evaporates water collected in the defrosted water dish 11. The refrigerant is then introduced in the main condenser 13. While passing through the main condenser 13, the refrigerant carries out a heat exchange with ambient air in accordance with the natural or forced convection phenomenon, so that it is cooled to have a liquid phase under low temperature and high pressure.

The liquid-phase refrigerant of low temperature and high pressure, which has been liquefied in the main condenser tube 13, enters the anti-dewing pipe 15. While passing through the anti-dewing pipe 15, the refrigerant is changed to a phase with a more or less higher temperature of about 6° to 13° C. As a result, the generation of dewdrops in the refrigerator is prevented. The liquid-phase refrigerant of low temperature and high pressure then passes through the capillary tube 14 which serves to expand the refrigerant, thereby reducing its pressure to an evaporation pressure. By the capillary tube 14, the refrigerant has low temperature and pressure. The refrigerant emerging from the capillary tube 14 is then introduced in the evaporator 4.

While passing through the evaporator 4 which is constituted by a plurality of pipes, the refrigerant of low temperature and pressure carries out a heat exchange with ambient air. By this heat exchange, the refrigerant is vaporized while cooling the air. The resultant gaseous refrigerant of low temperature and pressure emerging from the evaporator 4 is then introduced in the compressor 10. Thus, the refrigerant circulates the refrigerating cycle repeatedly, as shown in FIG. 2.

On the other hand, the cold air heat-exchanged with the refrigerant in the evaporator 4 is blown by a rotating force of the fan 5*a* and guided by the duct members 8 and 9 so that it is discharged into the freezing and refrigerating compartments 2 and 3 through the cold air discharge ports 8*a* and 9*a*.

By the cold air discharged into the freezing and refrigerating compartments 2 and 3 through the cold air discharge ports 8*a* and 9*a*, the internal temperatures of the freezing and refrigerating compartments 2 and 3 are gradually reduced to certain levels, respectively.

During the cold air discharging operation, the damper 6 arranged at the rear side of the duct member 9 for the refrigerating compartment 3 controls the amount of cold air supplied to the refrigerating compartment 3 on the basis of the variable internal temperature of the refrigerating compartment 3 so that the refrigerating compartment 3 can be maintained at an appropriate temperature.

As apparent from the above description, the above-mentioned conventional refrigerator uses the control system for controlling the internal temperatures of the freezing and refrigerating compartments 2 and 3 based on the internal temperature of the freezing compartment 2. That is, this temperature control is achieved in such a manner that the compressor 10 and fan motor 5 are driven to circulate cold air through the freezing compartment 2 when the internal temperature of the freezing compartment 2 is higher than a predetermined temperature, while being stopped to cut off the supply of cold air to the freezing compartment 2 when the internal temperature of the freezing compartment 2 is not higher than the predetermined temperature.

Since only the internal temperature of the freezing compartment 2 is used to control the compressor 10, however, the conventional refrigerator involves various problems. For example, the internal temperature of the freezing compartment may be at a low level even when the internal temperature of the refrigerating compartment is abruptly increased over its predetermined level due to the overload state of the refrigerating compartment or an increased number of times opening the refrigerating compartment door. In this case, the compressor 10 is not driven. As a result, the internal temperature of the refrigerating compartment 3 is continuously increased, so that food stored in the refrigerating compartment may spoil easily. Therefore, there is a degradation in reliability.

In the conventional evaporator including the single evaporator 4 and the single fan 5*a*, moisture existing in air being blown by the fan 5*a* is frosted on the evaporator 4 when the air is cooled by the refrigerant passing through the evaporator 4.

In order to defrost the frost formed on the evaporator 4, power is applied to a heater (not shown). When the heater is heated, the frost on the evaporator 4 is melted and then drained to the defrosted water dish 11 disposed at the lower portion of the refrigerator body 1.

Although a more or less amount of frost formed on the evaporator is removed by melting it in the above-mentioned refrigerator, defrosted water produced between adjacent pins of the evaporator is still attached on the evaporator 4 because of its cohesion. This defrosted water is frozen by the cold air heat-exchanged at the evaporator by the lapse of time, thereby degrading the heat exchanging ability of the evaporator. Furthermore, the evaporator itself may be frozen. In this case, the evaporator may be damaged.

In order to solve such problems, another refrigerator have recently been proposed which has an arrangement including evaporators respectively associated with freezing and refrigerating compartments so that the defrosting operation for removing frost formed on the evaporators can be individually carried out for the evaporators. In this case, the defrosting operation can be efficiently achieved because it is individually carried out for the evaporators. However, the period of time that the compressor is being stopped increases because the defrosting operations for the freezing and refrigerating compartments are carried out sequentially. For this reason, it is difficult to maintain the refrigerating compartment below a certain temperature.

SUMMARY OF THE INVENTION

Therefore, an object of the invention is to solve the above-mentioned problems and to provide a defrosting apparatus for a refrigerator and a method for controlling the defrosting apparatus, wherein the refrigerating compartment is cooled irrespective of the internal temperature of the freezing compartment when the internal temperature of the refrigerating compartment is higher than a predetermined temperature, so that the refrigerating compartment is maintained below the predetermined temperature.

Another object of the invention is to provide a defrosting apparatus for a refrigerator and a method for controlling the defrosting apparatus, wherein the defrosting operation is carried out in accordance with the drive times of the compressor and refrigerating compartment fan when the internal temperature of the refrigerating compartment is higher than the predetermined temperature even though the compressor and refrigerating compartment fan are continuously driven, so that the cooling efficiency can be improved.

Another object of the invention is to provide a defrosting apparatus for a refrigerator and a method for controlling the defrosting apparatus, wherein the point of time when the defrosting operation begins is determined on the basis of the environmental temperature condition, so that the defrosting operation can be efficiently achieved.

Another object of the invention is to provide a defrosting apparatus for a refrigerator and a method for controlling the defrosting apparatus, wherein the defrosting operation for the freezing compartment is delayed when the defrosting operation for the refrigerating compartment is achieved within a predetermined time under the defrost requiring condition of the freezing compartment so that the defrosting operations for the freezing and refrigerating compartments can be simultaneously carried out.

Another object of the invention is to provide a defrosting apparatus for a refrigerator and a method for controlling the defrosting apparatus, wherein the defrosting operations for the freezing and refrigerating compartments are simultaneously carried out irrespective of the defrost requiring condition of the refrigerating compartment when the freezing compartment is under the defrost requiring condition, so that the refrigerating efficiency can be improved.

Another object of the invention is to provide a defrosting apparatus for a refrigerator and a method for controlling the defrosting apparatus, wherein the defrosting operations for the freezing and refrigerating compartments are simultaneously carried out irrespective of the defrost requiring condition of the freezing compartment when the refrigerating compartment is under the defrost requiring condition, so that the refrigerating efficiency can be improved.

Another object of the invention is to provide a defrosting apparatus for a refrigerator and a method for controlling the defrosting apparatus, wherein for the rapid refrigerating operation, the point of time when the defrosting operation for the refrigerating compartment begins is accurately determined by calculating a temperature drop gradient on the basis of a variation in the internal temperature of the refrigerating compartment, so that the defrosting operation can be efficiently achieved.

Another object of the invention is to provide a defrosting apparatus for a refrigerator and a method for controlling the defrosting apparatus, wherein for the rapid freezing operation, the point of time when the defrosting operation for the freezing compartment begins is accurately determined by calculating a temperature drop gradient on the basis of a variation in the internal temperature of the freezing compartment, so that the defrosting operation can be efficiently achieved.

In accordance with one aspect, the present invention provides an apparatus for defrosting a refrigerator, comprising: a refrigerating compartment for storing food to be refrigerated; a freezing compartment adapted to store food to be frozen, the freezing compartment being defined above the refrigerating compartment by an intermediate partition member; a compressor adapted to compress a refrigerant to that of high temperature and pressure under a control of compressor driving means; a pair of heat exchanging means respectively associated with the freezing and refrigerating compartments and adapted to heat-exchange flows of air, being blown into the freezing and refrigerating compartments, with the refrigerant, thereby cooling the air flows; a pair of fan means respectively associated with the freezing and refrigerating compartments and adapted to supply the cold air flows heat-exchanged with the heat exchanging means to the freezing and refrigerating compartments under a control of fan motor driving means; a pair of heating means respectively associated with the freezing and refrigerating compartments and adapted to defrost the freezing and refrigerating compartment heat exchanging means under a control of heater driving means; temperature sensing means adapted to sense respective internal temperatures of the freezing and refrigerating compartments; temperature setting means adapted to set respective desired temperatures of the freezing and refrigerating compartments, the temperature setting means also setting a rapid freezing operation and a rapid refrigerating operation; control means adapted to determine the point of time when a defrosting operation for each heat exchanging means begins on the basis of a drive time of the compressor and respective drive times of the freezing and refrigerating compartment fan means, the control means also calculating gradients of respective internal temperatures of the freezing and refrigerating compartments, thereby determining defrost requiring conditions of the freezing and refrigerating compartments; and conduit temperature sensing means adapted to sense respective conduit temperatures of the freezing and refrigerating compartment heat exchanging means during respective heat generating operations of the freezing and refrigerating compartment heating means.

In accordance with another aspect, the present invention provides a method for controlling a defrosting operation of a refrigerator, comprising: temperature setting step of setting respective desired temperature of freezing and refrigerating compartments by freezing and refrigerating compartment temperature setting means; normal operation step of lowering respective internal temperatures of the freezing and refrigerating compartments to the desired temperatures set at the temperature setting step in accordance with driving of a compressor and driving of freezing and refrigerating compartment fan means; freezing compartment temperature determining step of determining whether or not the internal temperature of the freezing compartment is higher than its desired temperature set by the freezing compartment temperature setting means; refrigerating compartment temperature determining step of driving the compressor when the internal temperature of the freezing compartment is determined at the freezing compartment temperature determining step as being higher than its desired temperature and then determining whether or not the internal temperature of the refrigerating compartment is higher than its desired temperature set by the refrigerating compartment temperature setting means; refrigerating compartment fan means driving step of driving refrigerating compartment fan means when the internal temperature of the refrigerating compartment is determined at the refrigerating compartment temperature determining step as being higher than its desired temperature set by the refrigerating compartment temperature setting means, thereby lowering the internal temperature of the refrigerating compartment; refrigerating compartment fan means stopping step of stopping the refrigerating compartment fan means when the internal temperature of the refrigerating compartment is determined at the refrigerating compartment temperature determining step as being lower than its desired temperature set by the refrigerating compartment temperature setting means; freezing compartment fan means driving step of driving the freezing compartment fan means when the internal temperature of the refrigerating compartment is lower than its desired temperature set by the refrigerating compartment temperature setting means after executing both the refrigerating compartment fan means driving and stopping steps; refrigerating compartment temperature sensing step of stopping both the compressor and the freezing compartment fan means when the internal temperature of the freezing compartment is lower than its desired temperature set by the freezing compartment temperature setting means, and then sensing the internal temperature of the refrigerating compartment; refrigerating compartment temperature determining step of determining whether or not the internal temperature of the refrigerating compartment sensed at the refrigerating compartment temperature sensing step is higher than a predetermined temperature stored in control means; time elapse determining step of determining whether or not the refrigerating compartment a predetermined time has elapsed under a condition that the internal temperature of the refrigerating compartment is higher than the predetermined temperature; drive time counting step of driving both the compressor and the refrigerating compartment fan means when it is determined at the time elapse determining step that the predetermined time has elapsed, and then counting the drive time of the refrigerating compartment fan means; drive time determining step of determining whether or not the drive time of the refrigerating compartment fan means counted at the drive time counting step is more than a predetermined time stored in the control means; total drive time determining step of clearing the counted drive time of the refrigerating compartment fan means when the drive time of the refrigerating compartment fan means is determined at the drive time determining step as being less than the predetermined time stored in the control means, and then determining whether or not the total drive time of the compressor is more than a predetermined total drive time stored in the control unit; heating step of driving refrigerating compartment evaporator heating means when the total drive time is determined at the total drive time determining step as being more than the predetermined total drive time, thereby defrosting a refrigerating compartment evaporator; refrigerating compartment conduit temperature sensing step of sensing a conduit temperature of the refrigerating compartment evaporator while the refrigerating compartment evaporator heating means is generating heat; and refrigerating compartment conduit temperature determining step of determining whether or not the conduit temperature of the refrigerating compartment evaporator sensed at the refrigerating compartment conduit temperature sensing step is higher than a predetermined conduit temperature stored in the control means.

In accordance with another aspect, the present invention provides a method for controlling a defrosting operation of a refrigerator, comprising: drive time calculating step of calculating a drive time of a compressor and respective drive times of freezing and refrigerating compartment fan means; defrost requiring condition determining step of determining respective defrost requiring conditions of freezing and refrigerating compartment evaporators on the basis of the drive time of the compressor and the drive times of the freezing and refrigerating compartment fan means all calculated at the drive time calculating step; defrosting operation step of executing a defrosting operation for removing frost formed on the freezing and refrigerating compartment evaporators in accordance with the defrost requiring conditions of the freezing and refrigerating compartment evaporators determined at the defrost requiring condition determining step; and defrosting end determining step of sensing respective conduit temperatures of the freezing and refrigerating compartment evaporators being varied during the defrosting operation executed at the defrosting operation step, and determining whether or not the frost on the freezing and refrigerating compartment evaporators has been completely removed on the basis of the sensed conduit temperatures.

In accordance with another aspect, the present invention provides a method for controlling a defrosting operation of a refrigerator, comprising: refrigerating compartment fan means's drive time calculating step of calculating a drive time of refrigerating compartment fan means in accordance with an operation mode of the refrigerator being variable when the refrigerating compartment fan is driven; refrigerating compartment evaporator's defrost requiring condition determining step of determining a defrost requiring condition of a refrigerating compartment evaporator on the basis of the drive time of the refrigerating compartment fan means calculated at the refrigerating compartment fan means's drive time calculating step; freezing compartment fan means's drive time calculating step of calculating a drive time of freezing compartment fan means when the freezing compartment fan is driven in accordance with the internal temperature of the freezing compartment; freezing compartment evaporator's defrost requiring condition determining step of determining a defrost requiring condition of a freezing compartment evaporator on the basis of the drive time of the freezing compartment fan means calculated at the freezing compartment fan means's drive time calculating step; and simultaneous defrosting operation step of simultaneously executing defrosting operations for removing frost formed on the freezing and refrigerating compartment evaporators when the refrigerating compartment evaporator is determined as being under the defrost requiring condition at the refrigerating compartment evaporator's defrost requiring condition determining step.

In accordance with another aspect, the present invention provides a method for controlling a defrosting operation of a refrigerator, comprising: initial temperature sensing step of sensing an initial internal temperature of a refrigerating compartment when a rapid cooling operation is executed; rapid refrigerating operation step of driving the compressor and the refrigerating compartment fan means, thereby executing a rapid refrigerating operation for the refrigerating compartment; temperature sensing step of sensing an internal temperature of the refrigerating compartment being varied at sampling time intervals while counting the drive time of the refrigerating compartment fan means; temperature variation calculating step of calculating a temperature drop gradient corresponding to a variation in the internal temperature of the refrigerating compartment on the basis of the temperature sensed at the temperature sensing step and the initial temperature sensed at the initial temperature sensing step; defrost beginning point determining step of determining a point of time when a defrosting operation for a refrigerating compartment evaporator begins on the basis of the temperature variation calculated at the temperature variation calculating step; and defrosting operation step of executing the defrosting operation of the refrigerating compartment evaporator in accordance with the defrost beginning point determined at the defrost beginning point determining step.

In accordance with another aspect, the present invention provides a method for controlling a defrosting operation of a refrigerator, comprising: normal operation step of executing a cooling operation by driving a compressor on the basis of an internal temperature of a freezing compartment and by controlling refrigerating compartment fan means on the basis of respective internal temperatures of freezing and refrigerating compartments being varied; compartment temperature sensing step of sensing the internal temperatures of the freezing and refrigerating compartments being varied during the cooling operation executed at the normal operation step; abnormal temperature determining step of determining whether the freezing and refrigerating compartments are in abnormal temperature states, respectively, on the basis of the internal temperatures of the freezing and refrigerating compartments sensed at the compartment temperature sensing step; abnormal cooling operation step of cooling the freezing and refrigerating compartments when the freezing and refrigerating compartments are determined at the abnormal temperature determining step as being in abnormal temperature states, respectively; cooling temperature sensing step of sensing respective internal temperatures of the freezing and refrigerating compartments being varied upon driving the freezing and refrigerating compartment fan means along with the compressor; defrost beginning point determining step of determining respective points of time when defrosting operations for freezing and refrigerating compartment evaporators begin, on the basis of respective drive times of the freezing and refrigerating compartment fan means along with the drive time of the compressor, when the internal temperatures of the freezing and refrigerating compartments sensed at the cooling temperature sensing step are higher than predetermined temperatures respectively stored in control means; and defrosting operation step of executing the defrosting operations for the freezing and refrigerating compartment evaporators respectively in accordance with the defrost beginning points determined at the defrost beginning point determining step.

BRIEF DESCRIPTION OF THE DRAWINGS

Other objects and aspects of the invention will become apparent from the following description of embodiments with reference to the accompanying drawings in which.

DETAILED DESCRIPTION OF THE INVENTION

Figure 1:
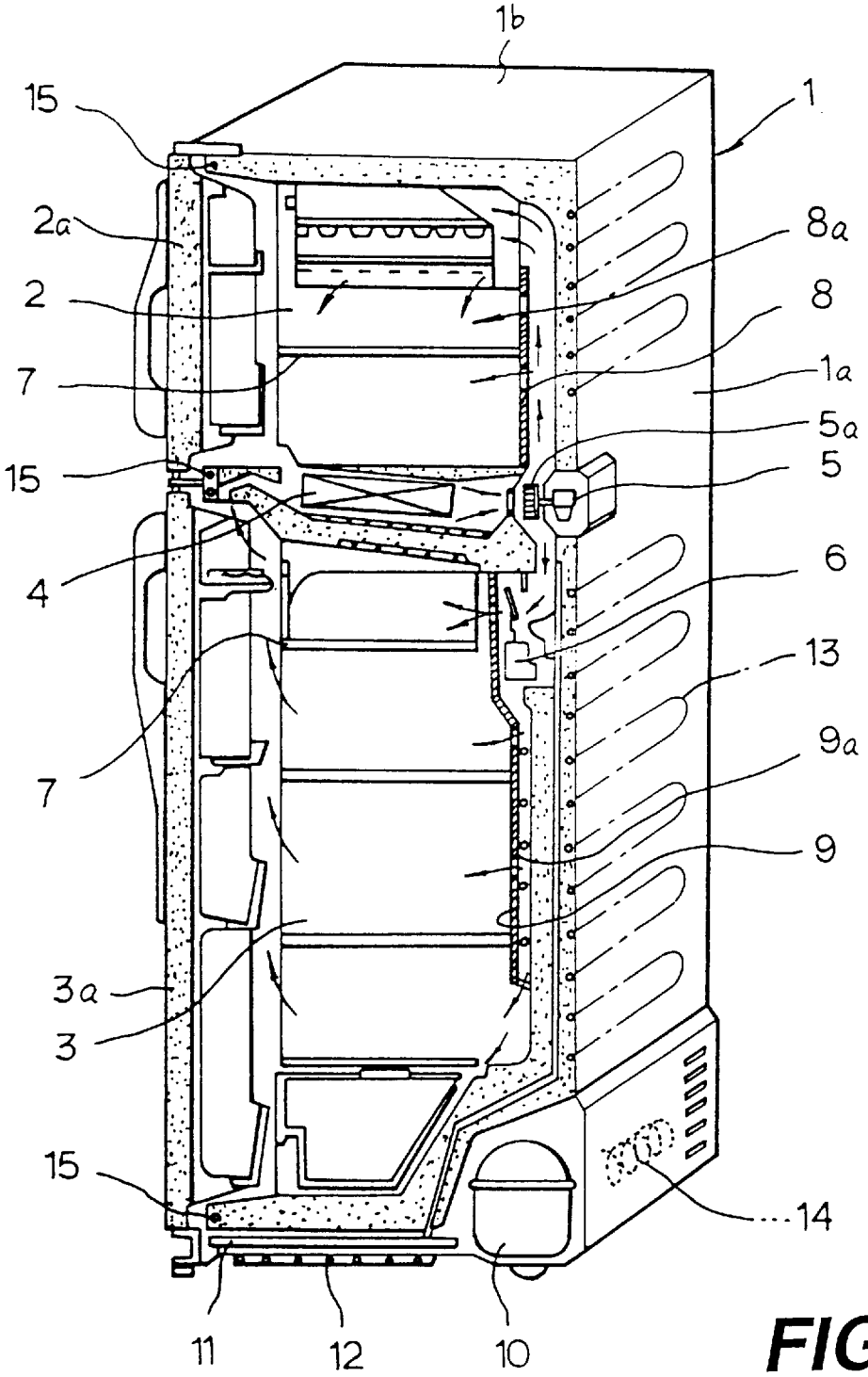
FIG. 1 (PRIOR ART)
FIG. 1 is a partially-broken perspective view illustrating a conventional refrigerator.
Figure 2:
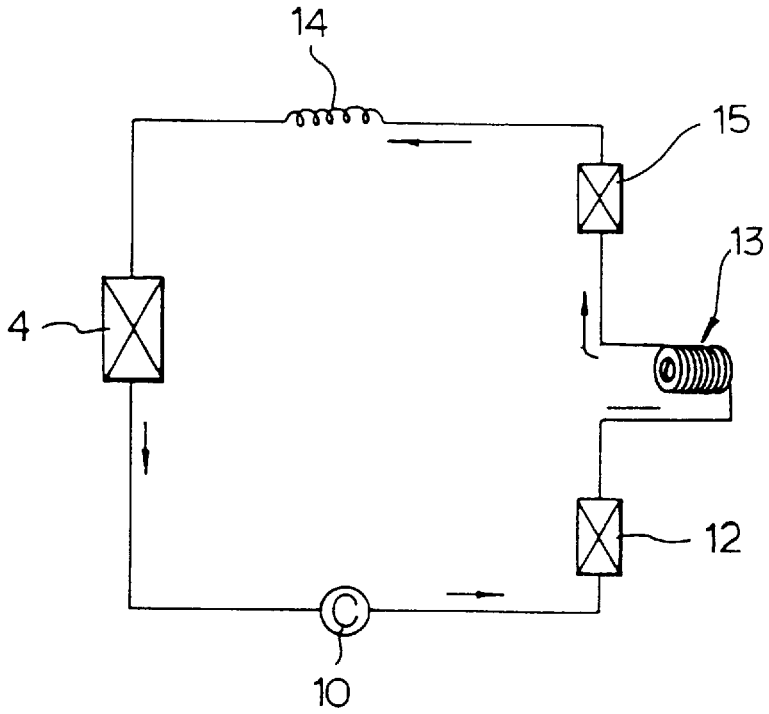
FIG. 2 (PRIOR ART)
FIG. 2 is a circuit diagram illustrating a refrigerating cycle employed in the conventional refrigerator.
Figure 3:
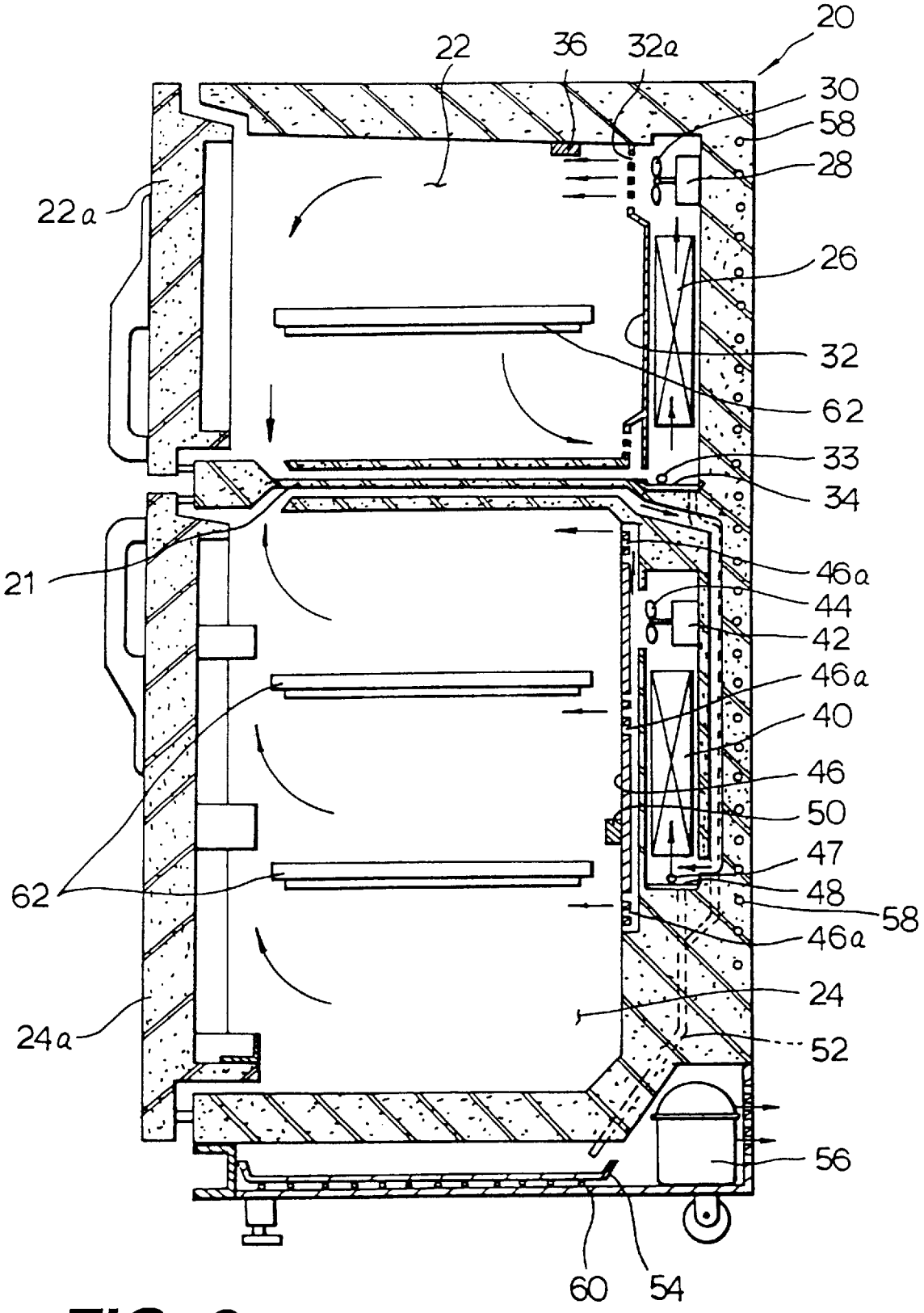
FIG. 3 is a sectional view illustrating a refrigerator to which a defrosting apparatus according to the present invention is applied.
Figure 4:
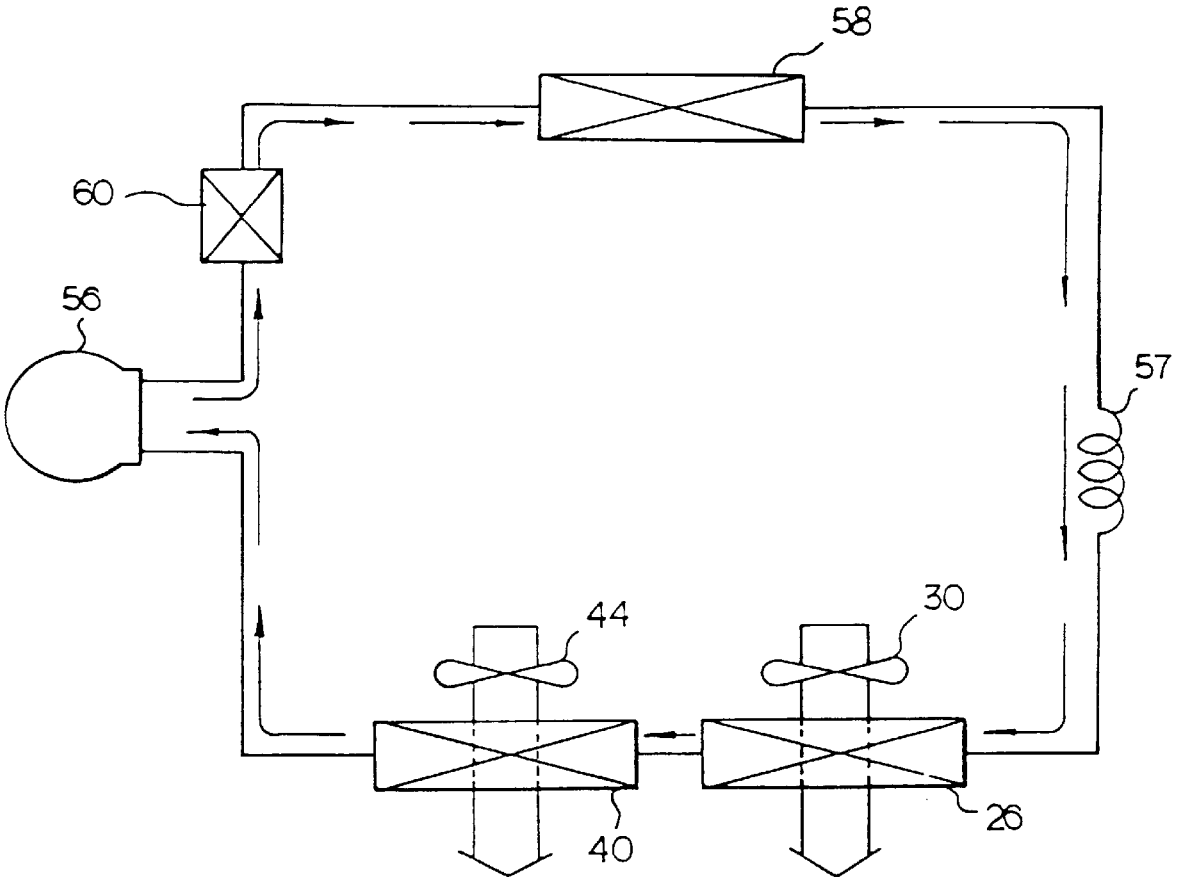
FIG. 4 is a circuit diagram illustrating a refrigerating cycle according to the present invention.

FIG. 3 illustrates a refrigerator to which a defrosting apparatus according to the present invention is applied. On the other hand, FIG. 4 illustrates a refrigerating cycle employed in the refrigerator.

As shown in FIG. 3, the refrigerator includes a refrigerator body 20 which is vertically divided into two compartments, namely, a freezing compartment 22 and a refrigerating compartment 24 by an intermediate wall member 21. At the front portion of the refrigerator body 20, doors 22*a* and 24*a* are mounted which serve to open and close the freezing and refrigerating compartments 22 and 24, respectively.

The freezing and refrigerating compartments 22 and 24 serve as food storing compartments, respectively.

At the rear portion of the freezing compartment 22, a freezing compartment evaporator 26 is mounted which carries out a heat exchange between air being blown into the freezing compartment 22 and the refrigerant passing through the first evaporator 26, thereby evaporating the refrigerant by latent heat from the air while cooling the air. A freezing compartment fan 30 is arranged above the freezing compartment evaporator 26. The freezing compartment fan 30 is driven by a freezing compartment fan motor 28 to circulate the cold air heat-exchanged by the freezing compartment evaporator 26 in the freezing compartment 22.

At the front of the freezing compartment evaporator 26, namely, at the rear of the freezing compartment 22, a freezing compartment duct member 32 is disposed which serves to guide a flow of cold air heat-exchanged by the freezing compartment evaporator 26 such that it circulates through the freezing compartment 22 by the rotating force of the freezing compartment fan 30. The freezing compartment duct member 32 is provided with an air discharge port 32*a* through which the cold air guided by the freezing compartment duct member 32 after being heat-exchanged by the freezing compartment evaporator 26 is introduced in the freezing compartment 22.

A heater 33 is disposed beneath the freezing compartment evaporator 26. The heater 33 generates heat to remove frost formed on the freezing compartment evaporator 26 when air being blown by the freezing compartment fan 30 is cooled by refrigerant passing through the freezing compartment evaporator 26.

A defrosted water dish 34 is disposed beneath the heater 33 provided for the freezing compartment evaporator 26. The defrosted water dish 34 collects defrosted water and subsequently drains the collected water through a drain hose 52 to an evaporating dish 54 disposed at the bottom of the refrigerator body 20. A thermistor 36 is disposed at the front side of the freezing compartment fan 30 to sense the internal temperature Tf of the freezing compartment 22. The thermistor 36 constitutes a freezing compartment temperature sensing unit 111 of a temperature sensing unit 110 included in the defrosting apparatus which will be described hereinafter.

On the other hand, a refrigerating compartment evaporator 40 is mounted at the rear side of the refrigerating compartment 24. The refrigerating compartment evaporator 40 carries out a heat exchange between air being blown into the refrigerating compartment 24 and the refrigerant passing through the refrigerating compartment evaporator 40, thereby evaporating the refrigerant by latent heat from the air while cooling the air. Above the refrigerating compartment evaporator 40, a refrigerating compartment fan 44 is rotatably mounted to the rotating shaft of a fan motor 42. The refrigerating compartment fan 44 is driven to circulate the cold air heat-exchanged by the refrigerating compartment evaporator 40 in the refrigerating compartment 24.

At the front of the refrigerating compartment evaporator 40, a refrigerating compartment duct member 46 is disposed which serves to guide a flow of cold air heat-exchanged by the refrigerating compartment evaporator 40 such that it circulates through the refrigerating compartment 24 by the rotating force of the refrigerating compartment fan 44. The refrigerating compartment duct member 46 is provided with an air discharge port 46*a*. Through the air discharge port 46*a*, the cold air guided by the refrigerating compartment duct member 46 is introduced in the refrigerating compartment 24.

Another heater 47 is disposed beneath the refrigerating compartment evaporator 40. The heater 47 generates heat to remove frost formed on the refrigerating compartment evaporator 40 when air being blown by the refrigerating compartment fan 44 is cooled by refrigerant passing through the refrigerating compartment evaporator 40.

Another dewdrop dish 48 is disposed beneath the heater 47 provided for the refrigerating compartment evaporator 40. The dewdrop dish 48 collects defrosted water and subsequently drains the collected water through the drain hose 52 to the evaporating dish 54 disposed at the bottom of the refrigerator body 20. Another thermistor 50 is disposed at the front of the refrigerating compartment duct member 46 to sense the internal temperature Tr of the refrigerating compartment 24. The thermistor 50 constitutes a refrigerating compartment temperature sensing unit 112 of the temperature sensing unit 110 which will be described hereinafter.

A compressor 56 is mounted at the lower portion of the refrigerator body 20 to compress the gaseous refrigerant of low temperature and pressure, emerging from the freezing and refrigerating compartment evaporators 26 and 40, to that of high temperature and pressure. A main condenser 58 is arranged at the rear portion of the refrigerator body 20. Through the main condenser 58, the gaseous refrigerant of high temperature and pressure passes which has been compressed by the compressor 56. While passing through the main condenser 58, the gaseous refrigerant carries out a heat exchange with ambient air in accordance with the natural or forced convection phenomenon, so that it is forcedly cooled to have a liquid phase under low temperature and high pressure.

An assistant condenser 60 is arranged beneath the evaporating dish 54 to evaporate water collected in the evaporating dish 54. A plurality of shelves 62 are disposed in both the freezing and refrigerating compartments 22 and 24 to partition the compartments into several food storing sections.

In the refrigerator having the above-mentioned arrangement, the refrigerant circulates through the refrigerating cycle shown in FIG. 4. That is, the refrigerant of high temperature and pressure compressed by the compressor 56 is fed to the assistant condenser 60. While passing through the assistant condenser 60, the refrigerant heats water collected in the evaporating dish 54, thereby evaporating the collected water. The refrigerant from the assistant condenser 60 is then introduced in the main condenser 58. While passing through the main condenser 58, the refrigerant of high temperature and pressure is cooled so that it can be liquefied into that of low temperature and pressure. The refrigerant emerging from the main condenser 58 then passes through the capillary tube 57 which reduces the pressure of the refrigerant. The refrigerant is then returned to the compressor 56 after passing through the freezing and refrigerating compartment evaporators 26 and 40.

Now, the defrosting apparatus of the present invention, which is applied to the refrigerator having the above-mentioned arrangement, will be described in detail.

Figure 5:
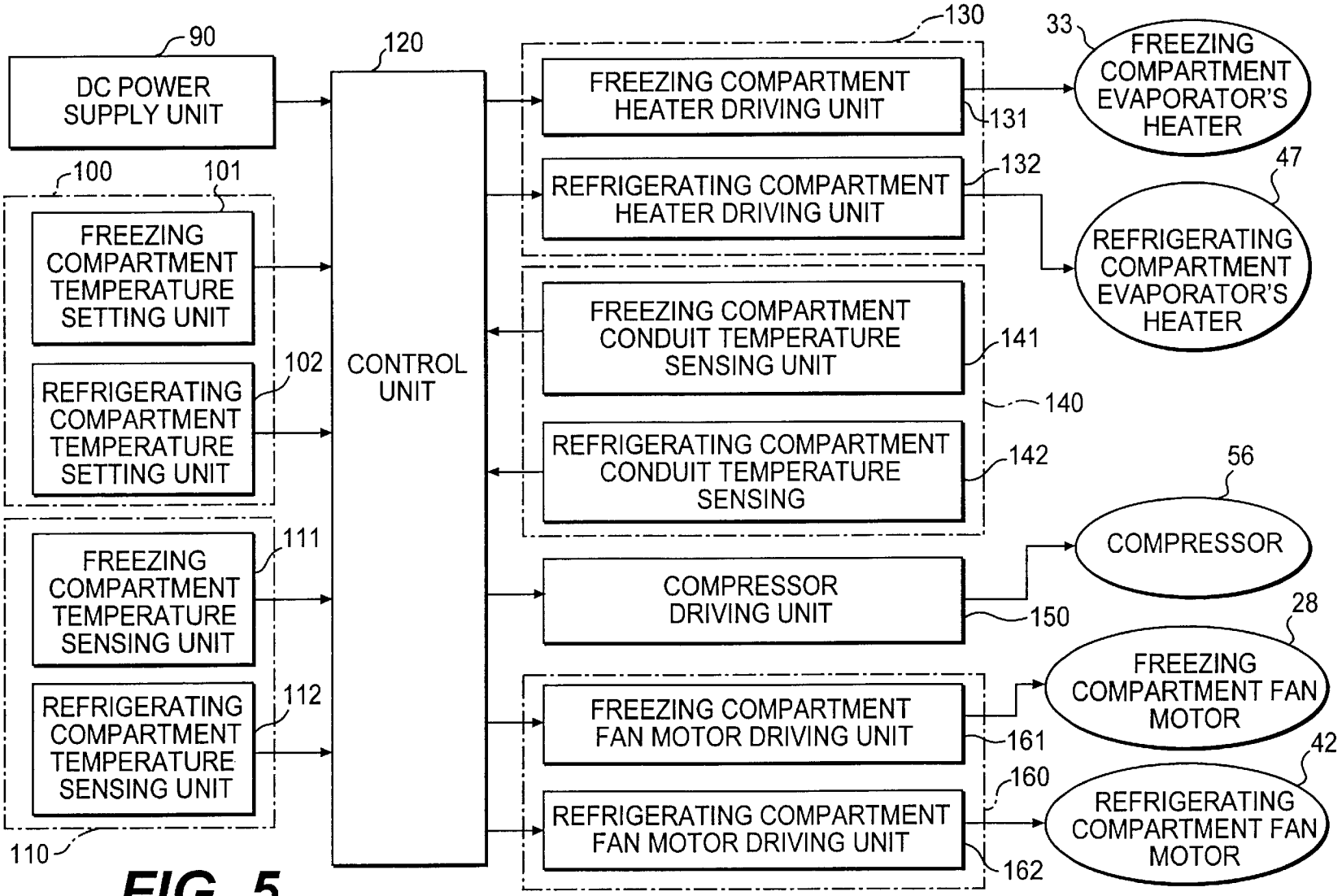
FIG. 5 is a block diagram illustrating the defrosting apparatus according to the present invention.

FIG. 5 is a block diagram illustrating the defrosting apparatus according to the present invention.

As shown in FIG. 5, the defrosting apparatus includes a DC power supply unit 90 for converting a source voltage from a commercial AC power source, input at an AC power input stage (not shown), into a DC voltage with a voltage level required to drive various units of the refrigerator.

A temperature setting unit 100 is also provided, which is a key switch manipulated by a user to set desired internal temperatures Tfs and Trs of the freezing and refrigerating compartments. The temperature setting unit 100 includes a freezing compartment temperature setting unit 101 adapted to set the desired internal temperature Tfs of the freezing compartment 22 and a refrigerating compartment temperature setting unit 102 adapted to set the desired internal temperature Trs of the refrigerating compartment 24. The freezing compartment temperature setting unit 101 is also used to select a rapid freezing operation whereas the refrigerating compartment temperature setting unit 102 is also used to select a rapid refrigerating operation.

The temperature sensing unit 110, which is also included in the defrosting apparatus, serves to sense respective internal temperatures Tf and Tr of the freezing and refrigerating compartment 22 and 24. This temperature sensing unit 110 includes a freezing compartment temperature sensing unit 111 which comprises the thermistor 36 to sense the internal temperature Tf of the freezing compartment 22 and a refrigerating compartment temperature sensing unit 112 which comprises the thermistor 50 to sense the internal temperature Tr of the refrigerating compartment 24.

The defrosting apparatus also includes a control unit 120 which is a microcomputer. The control unit 120 receives the DC voltage from the DC power supply unit 90 and then initializes the refrigerator. The control unit 120 also receives output signals from the temperature sensing unit 110 indicative of respective sensed internal temperatures Tf and Tr of the freezing and refrigerating compartments 22 and 24 and determines whether or not the sensed internal temperatures Tf and Tr are higher than the desired temperatures Tfs and Trs set by the temperature setting unit 100. On the basis of the determined result, the control unit 120 controls the overall operation of the refrigerator. The control unit 120 also controls the defrosting operation for the freezing and refrigerating compartments 22 and 24. For this control, the control unit 120 determines the time required to defrost the freezing and refrigerating compartment evaporators 26 and 40 on the basis of the drive time of the compressor 56 and respective drive times of the freezing and refrigerating compartment fans 30 and 44, respective internal temperatures Tf and Tr of the freezing and refrigerating compartments 22 and 24 and change of the operation mode of the refrigerator (in particular, the change between the overload operation mode and the normal operation mode).

To control the defrosting operation for the freezing and refrigerating compartments 22 and 24 during the rapid freezing operation for the freezing compartment 22 or during the rapid refrigerating operation for the refrigerating compartment 24, the control unit 120 also determines whether or not the freezing and refrigerating compartment evaporators 26 and 40 have been frosted, on the basis of respective temperature gradients Ta of the compartment temperatures Tf and Tr.

A heater driving unit 130 is coupled to the control unit 120 The heater driving unit 130 serves to drive the heaters 33 and 47 respectively associated with the freezing and refrigerating compartment evaporators 26 and 40 under a control of the control unit 120 in order to defrost the evaporators 26 and 40. The heater driving unit 130 drives the heaters 33 and 47 when the control unit 120 determines the defrost requiring condition of the freezing and refrigerating compartment evaporators 26 and 40 on the basis of the drive time of the compressor 56 and respective drive times of the freezing and refrigerating compartment fans 30 and 44, respective internal temperatures Tf and Tr of the freezing and refrigerating compartments 22 and 24, and respective temperature gradients Ta of the compartment temperatures Tf and Tr occurring during the rapid freezing or refrigerating operation. The heater driving unit 130 includes a freezing compartment heater driving unit 131 for driving the freezing compartment evaporator's heater 33 disposed beneath the freezing compartment evaporator 26 to remove frost formed on the freezing compartment evaporator 26 under a control of the control unit 120, and a refrigerating compartment heater driving unit 132 for driving the refrigerating compartment evaporator's heater 47 disposed beneath the refrigerating compartment evaporator 40 to remove frost formed on the refrigerating compartment evaporator 40 under a control of the control unit 120.

The defrosting apparatus further includes a conduit temperature sensing unit 140 for sensing respective temperatures P1 and P2 of the conduits of the freezing and refrigerating compartment evaporators 26 and 40, namely, respective temperatures of refrigerant flows passing through the evaporators 26 and 40 during the driving of the heaters 33 and 47 and then sending the resultant conduit temperature data to the control unit 120 so that the control unit 120 can determine the stoppage of the defrosting operations for the evaporators 26 and 40. The conduit temperature sensing unit 140 includes a freezing compartment conduit temperature sensing unit 141 for sensing the conduit temperature P1 of the freezing compartment evaporator 26 being varied during the driving of the freezing compartment evaporator's heater 33 and sending the resultant data indicative of the sensed conduit temperature P1 to the control unit 120, and a refrigerating compartment conduit temperature sensing unit 142 for sensing the conduit temperature P2 of the refrigerating compartment evaporator 40 being varied during the driving of the refrigerating compartment evaporator's heater 47 and sending the resultant data indicative of the sensed conduit temperature P2 to the control unit 120.

A compressor driving unit 150 is also coupled to the control unit 120. The compressor driving unit 150 receives a control signal from the control unit 120 generated on the basis of a difference between the desired compartment temperature Tfs or Trs set by the user through the temperature setting unit 100 and the compartment temperature Tf or Tr sensed by the temperature sensing unit 110. In accordance with the control signal, the compressor driving unit 150 controls the compressor 56 to execute the cooling operation for the refrigerator.

In FIG. 5, the reference numeral 160 denotes a fan motor driving unit which serves to control the freezing and refrigerating compartment fan motors 28 and 42 under a control of the control unit 120 such that respective internal temperatures Tf and Tr of the freezing and refrigerating compartments 22 and 24 are maintained at their desired levels set by the user. As shown in FIG. 5, the fan motor driving unit 160 includes a freezing compartment fan motor driving unit 161 adapted to control the freezing compartment fan motor 28, which circulates the cold air heat-exchanged by the freezing compartment evaporator 26, under a control of the control unit 120 to maintain the internal temperature Tf of the freezing compartment 22 sensed by the freezing compartment temperature sensing unit 111 at its desired level Tfs set by the user, and a refrigerating compartment fan motor driving unit 162 adapted to control the refrigerating compartment fan motor 42, which circulates the cold air heat-exchanged by the refrigerating compartment evaporator 40, under a control of the control unit 120 to maintain the internal temperature Tr of the refrigerating compartment 24 sensed by the refrigerating compartment temperature sensing unit 112 at its desired level Trs set by the user.

The operation of the defrosting apparatus having the above-mentioned arrangement for controlling the defrosting operation of the refrigerator will now be described.

Figure 6A:
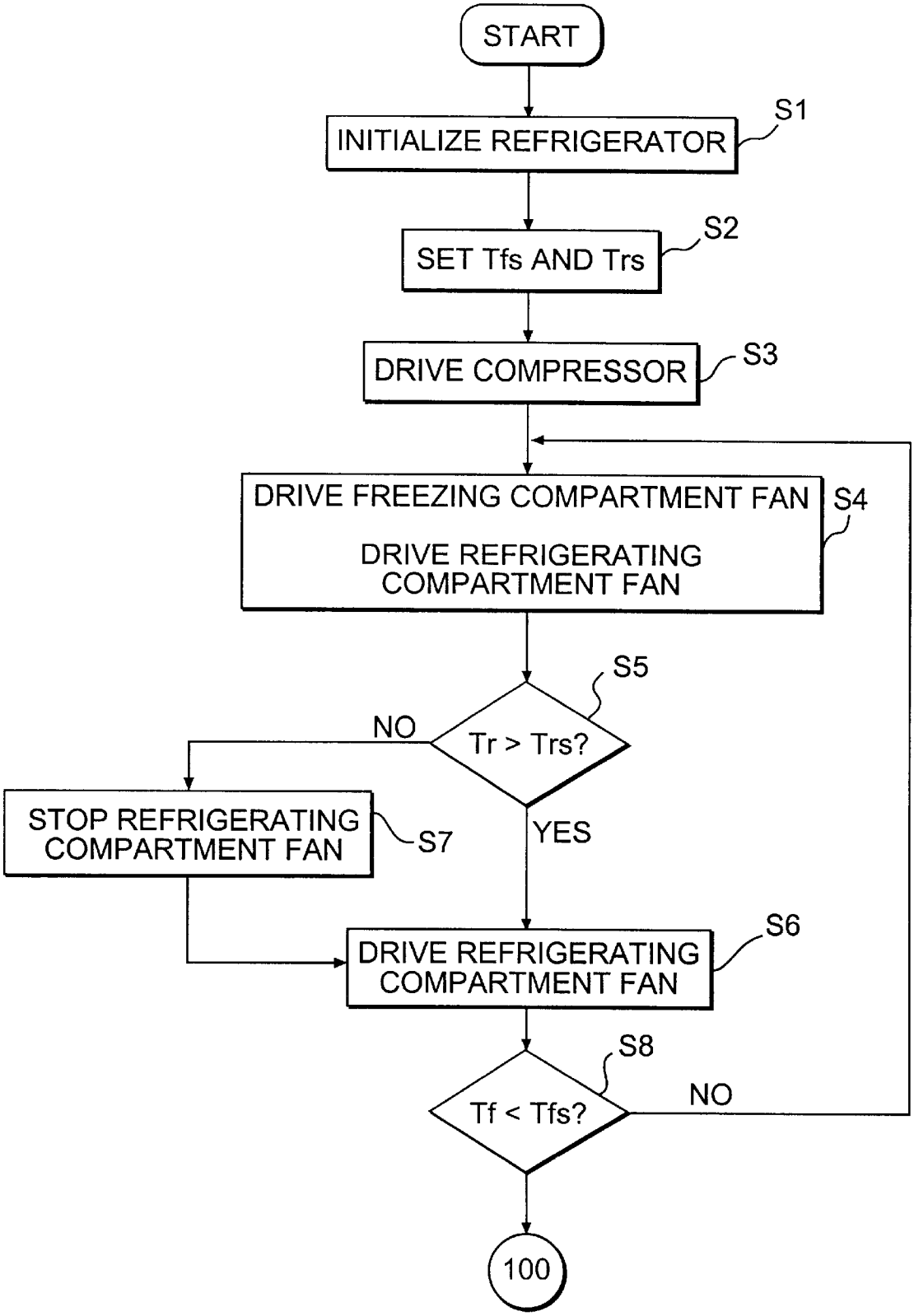
FIGS. 6A to 6C are flow charts respectively illustrating the sequence of a method for controlling the defrosting operation of the refrigerator in accordance with a first embodiment of the present invention.
Figure 6B:
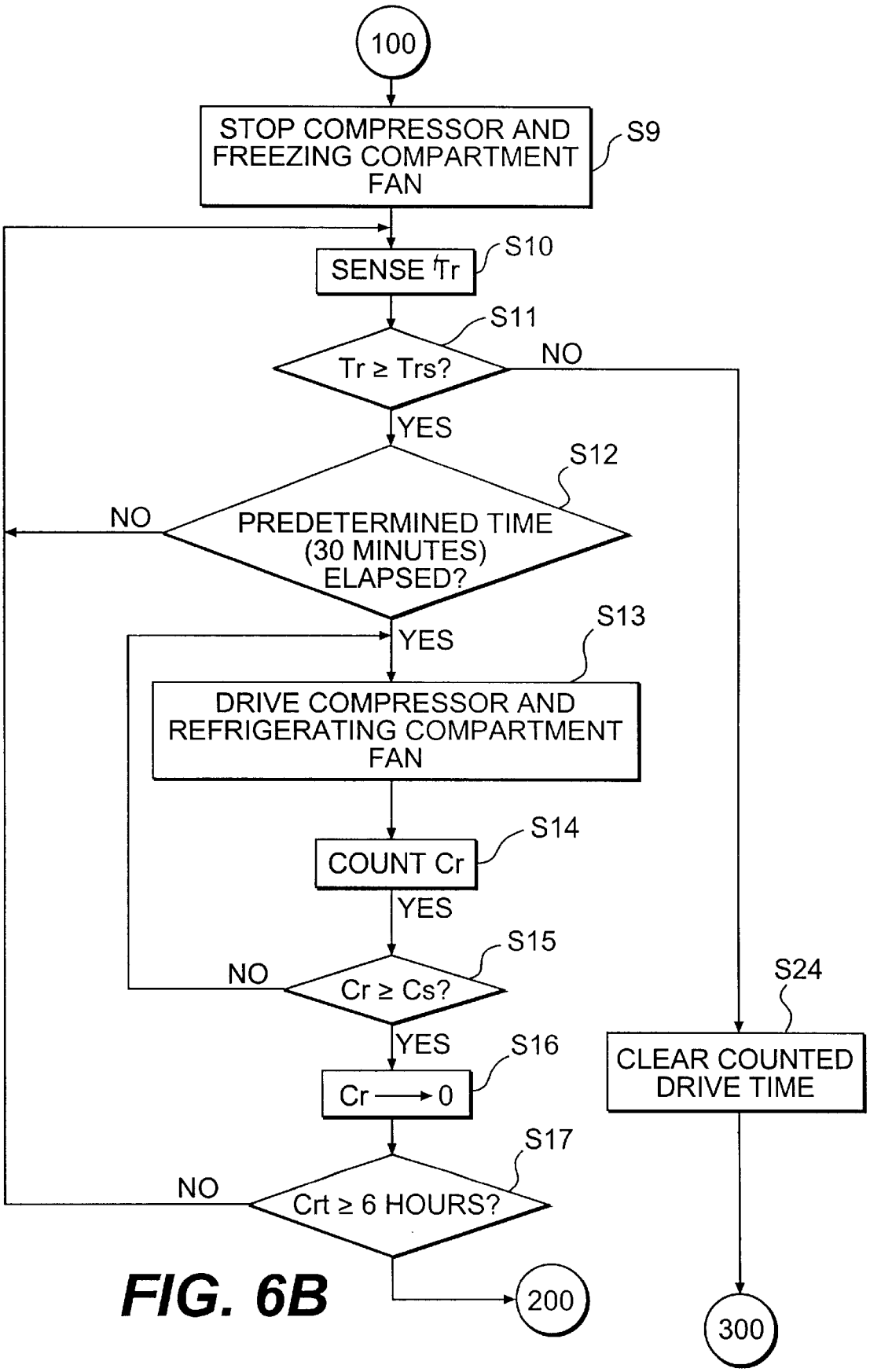
Figure 6C:
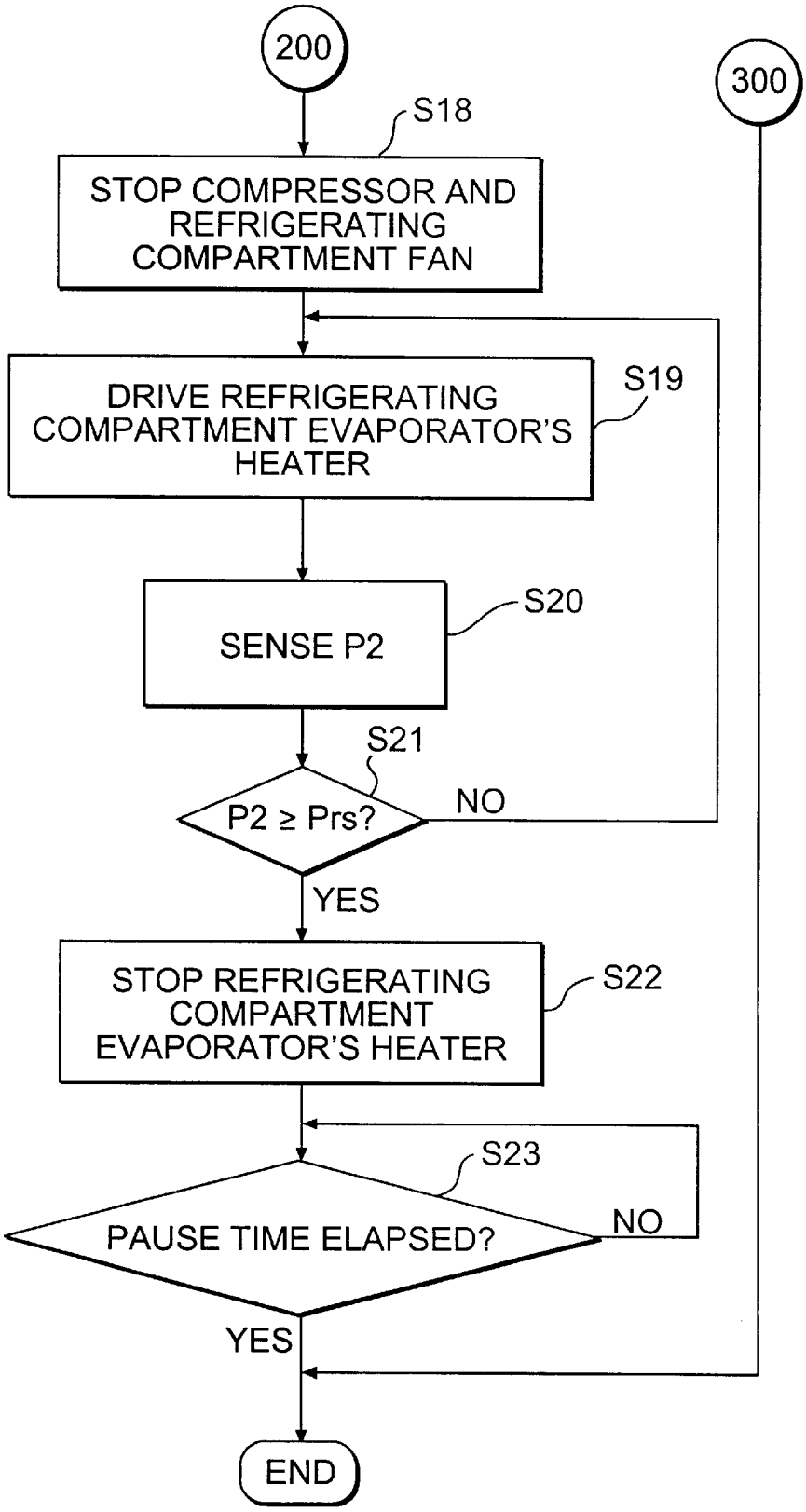

FIGS. 6A to 6C are flow charts respectively illustrating the sequence of a method for controlling the defrosting operation of the refrigerator in accordance with a first embodiment of the present invention.

Once the refrigerator is powered, the DC power supply unit 90 converts a source voltage received from a commercial AC power source at the AC power input stage (not shown) into a DC voltage with a voltage level required to drive various units of the refrigerator. The DC voltage from the DC power supply unit 90 is then applied to the control unit 120 as well as various driving circuits.

At step S1 of FIG. 6A, the control unit 120 initializes the refrigerator in response to the DC voltage received from the DC power supply unit 90 in order to operate the refrigerator. At step S2, the desired internal temperatures Tfs and Trs of the freezing and refrigerating compartments 22 and 24 are set using the freezing and refrigerating compartment temperature setting units 101 and 102 of the temperature setting unit 100.

The procedure then proceeds to step S3 to drive the compressor 56. Subsequently, the refrigerating compartment fan 44 and freezing compartment fan 30 are driven at step S4. At step S5, it is then determined whether or not the internal temperature Tr of the refrigerating compartment 24 sensed by the refrigerating compartment temperature sensing unit 112 is higher than the desired temperature Trs set in the control unit 120.

When the internal temperature Tr of refrigerating compartment 24 is determined at step S5 as being higher than the desired temperature Trs (namely, if YES), the procedure proceeds to step S6. At step S6, the refrigerating compartment fan 44 is continuously driven to lower the internal temperature of the refrigerating compartment 24. On the other hand, when the internal temperature Tr of refrigerating compartment 24 is determined at step S5 as being lower than the desired temperature Trs (namely, if NO), the procedure proceeds to step S7 to stop the refrigerating compartment fan 44.

Where the compressor 56 and refrigerating compartment fan 44 are driven while the freezing compartment fan 30 is being stopped, only the refrigerating compartment evaporator 40 can carry out a heat exchange between refrigerant and ambient air. That is, refrigerant compressed to a gaseous phase of high temperature and pressure is discharged out of the compressor 56 toward the assistant condenser 60. While passing through the assistant condenser 60, the refrigerant evaporates water collected in the evaporating dish 54. The refrigerant is then introduced in the main condenser 58. While passing through the main condenser 58, the refrigerant carries out a heat exchange with ambient air in accordance with the natural or forced convection phenomenon, so that it is cooled to have a liquid phase under low temperature and high pressure. That is, the refrigerant is liquefied.

The liquid-phase refrigerant of low temperature and high pressure, which has been liquefied in the main condenser 58, then passes through the capillary tube 57. By the capillary tube 57, the refrigerant is changed to that of low temperature and pressure so that it can be easily evaporated. The refrigerant emerging from the capillary tube 57 is then introduced in the freezing and refrigerating compartment evaporators 26 and 40.

While passing through the freezing and refrigerating compartment evaporators 26 and 40, each of which is constituted by a plurality of pipes, the refrigerant of low temperature and pressure carries out a heat exchange with air being blown into the freezing and refrigerating compartments 22 and 24. By this heat exchange, the refrigerant is vaporized while cooling the air. The resultant gaseous refrigerant flows of low temperature and pressure respectively emerging from the freezing and refrigerating compartment evaporators 26 and 40 are then introduced in the compressor 56. Thus, the refrigerant circulates the refrigerating cycle of FIG. 4 repeatedly.

In the above case, however, there is no flow of air being blown toward the freezing compartment 22 because the freezing compartment fan 30 is not driven. Accordingly, no heat exchange is carried out at the freezing compartment evaporator 26. The heat-exchange is carried out only at the refrigerating compartment evaporator 40.

The cold air heat-exchanged with the refrigerant by the refrigerating compartment evaporator 40 is blown by the rotating force of the refrigerating compartment fan 44 and guided by the refrigerating compartment duct member 46 so that it is discharged into the refrigerating compartment 24 through the cold air discharge port 46*a*. As a result, the refrigerating compartment 24 is cooled.

On the other hand, where the freezing compartment fan 30 is driven along with the compressor 56, thereby carrying out the cooling operation for the freezing compartment 22 for a certain period of time, the internal temperature Tf of the freezing compartment 22 is gradually lowered. This internal temperature Tf of the freezing compartment 22 is sensed by the freezing compartment temperature sensing unit 111 of the temperature sensing unit 110. The resultant sensing signal from the freezing compartment temperature sensing unit 111 is then applied to the control unit 120.

At step S8, it is then determined whether or not the internal temperature Tf of the freezing compartment 22 sensed by the freezing compartment. temperature sensing unit 111 is lower than the desired temperature Tfs.

When the internal temperature Tf of the freezing compartment 22 is determined at step S8 as being higher than the desired temperature Tfs (namely, if NO), the procedure returns to step S3. The procedure is then repeated from step S3 to continuously cool the freezing compartment 22. On the other hand, when the internal temperature Tf of the freezing compartment 22 is determined at step S8 as being lower than the desired temperature Tfs (namely, if YES), the procedure proceeds to step S9 of FIG. 6B. At step S9, the control unit 120 applies a control signal for stopping the cooling operation for the freezing compartment 22 to both the compressor driving unit 150 and the freezing compartment fan motor driving unit 161 of fan motor driving unit 160.

Accordingly, the compressor driving unit 150 stops the compressor 56 under the control of the control unit 120. The freezing compartment fan motor driving unit 161 also stops the freezing compartment fan motor 28 under the control of the control unit 120, thereby stopping the freezing compartment fan 30. As a result, the cooling operation for the freezing compartment 22 is completed.

As mentioned above, the compressor 56 is controlled in accordance with the internal temperature of the freezing compartment 22. When the compressor 56 is initially driven, the refrigerating compartment fan 44 is first driven. The refrigerating compartment fan 44 is controlled in accordance with the internal temperature of the refrigerating compartment 24 so that the refrigerating compartment 24 can be maintained at the desired temperature Trs. Once the internal temperature Tr of the refrigerating compartment 24 reaches the desired temperature Trs, the refrigerating compartment fan 44 is stopped, thereby completing the cooling operation for the refrigerating compartment 24. At the same time, the freezing compartment fan 30 is driven. The compressor 56 and freezing compartment fan 30 are continuously driven until the internal temperature Tf of the freezing compartment 22 reaches the desired temperature Tfs.

Once the internal temperature Tf of the freezing compartment 22 reaches the desired temperature Tfs, the compressor 56 and freezing compartment fan 30 are stopped to prevent the freezing compartment 22 from being in an over-freezing state.

In the normal operation mode for executing the freezing operation for the freezing compartment 22 and the refrigerating operation for the refrigerating compartment 24, the procedure then proceeds to step S10 to sense an abnormal temperature of the refrigerating compartment 24. At step S10, the refrigerating compartment temperature sensing unit 112 of the temperature sensing unit 110 senses the internal temperature Tr of the refrigerating compartment 24 and sends the resultant data to the control unit 120.

It is then determined at step S11 whether or not the internal temperature Tr of the refrigerating compartment 24 sensed by the refrigerating compartment temperature sensing unit 112 is higher than the desired temperature Trs (for example, about 8° C.) stored in the control unit 120. When the internal temperature Tr of the refrigerating compartment 24 is higher than the desired temperature Trs (namely, if YES), the procedure proceeds to step S12 because the refrigerating compartment 24 has been abruptly increased in temperature. At step S12, it is determined whether or not the refrigerating compartment 24 has been maintained for a predetermined time (for example, about 30 minutes) in the state that its internal temperature Tr is higher than the desired temperature Trs.

Where it is determined at step S12 that the predetermined time has not elapsed yet (namely, if NO), it is determined that the internal temperature of the refrigerating compartment 24 has been abruptly increased due to the number of accumulated door opening times or the accumulated door open time. In this case, the procedure returns to step S10. Then, the procedure from step S10 is repeated.

On the other hand, where it is determined at step S12 that the predetermined time has elapsed (namely, if YES), it is determined that the refrigerating compartment 24 is in an abnormal temperature state. In this case, the procedure proceeds to step S13. At step S13, the control unit 120 applies a control signal to both the compressor driving unit 150 and the refrigerating compartment fan motor driving unit 162 of fan motor driving unit 160 in order to cool the refrigerating compartment 24 irrespective of the internal temperature Tf of the freezing compartment 22.

Based on the control signal, the compressor driving unit 150 and refrigerating compartment fan motor driving unit 16f drive the compressor 56 and refrigerating compartment fan motor 42, respectively. Accordingly, the refrigerating compartment fan 44 is rotated.

When the compressor 56 and refrigerating compartment fan motor 42 are driven, the cold air heat-exchanged with the refrigerant at the refrigerating compartment evaporator 40 is introduced in the refrigerating compartment 24 through the cold air discharge port 46*a* by the rotating force of the refrigerating compartment fan 44.

Thereafter, the procedure proceeds to step S14 to count the drive time Cr of the refrigerating compartment fan 44 by a timer included in the control unit 120.

In order to check the drive time Cr of the refrigerating compartment fan 44, it is then determined at step S15 whether or not the drive time Cr counted by the timer is more than a predetermined drive time Cs (for example, about 40 minutes) stored in the control unit 120.

Where it is determined at step S15 that the predetermined drive time Cs has not elapsed yet (namely, if NO), the procedure returns to step S14. The procedure from the step S14 is then repeated while continuously sensing the internal temperature Tr of the refrigerating compartment 24. Where it is determined at step S15 that the predetermined drive time Cs has elapsed (namely, YES), the procedure proceeds to step S16 in order to clear the counted drive time Cr of the refrigerating compartment fan 44.

When the refrigerating compartment 24 is still maintained in the state that its internal temperature Tr is higher than the desired temperature Trs after being cooled by the continued driving (for about 40 minutes) of the refrigerating compartment fan 44, the procedure proceeds to step S17 to determine whether or not the increase in the internal temperature (namely, the abnormal temperature state) of the refrigerating compartment 24 resulted from a degradation in the heat exchanging ability of the refrigerating compartment evaporator 40 caused by frost formed on the evaporator 40. For this determination, it is determined whether or not the total drive time Crt of the refrigerating compartment fan 44 is more than a predetermined total drive time corresponding to the drive time (for example, 6 hours) of the compressor 56 causing the refrigerating compartment fan 40 to be frosted.

Where it is determined at step S17 that the total drive time Crt is less than 6 hours (namely, if NO), it is determined that the abnormal temperature state of the refrigerating compartment 24 did not result from the formation of frost on the refrigerating compartment evaporator 40. In this case, the procedure proceeds to step S10. The procedure from step S10 is then repeatedly executed.

On the other hand, where the total drive time Crt is determined at step S17 as being more than 6 hours (namely, if YES), it is determined that the abnormal temperature state of the refrigerating compartment 24 resulted from the formation of frost on the refrigerating compartment evaporator 40. In this case, the procedure proceeds to step S18 of FIG. 6C. At step S18, the control until 120 applies a control signal for stopping the cooling operation for the refrigerating compartment 24 to both the compressor driving unit 150 and the refrigerating compartment fan motor driving unit 162 of fan motor driving unit 160.

Based on the control signal from the control unit 120, the compressor driving unit 150 and refrigerating compartment fan motor driving unit 162 stop the compressor 56 and refrigerating compartment fan motor 42, respectively. As a result, the refrigerating compartment fan 44 is, stopped to prevent the refrigerating compartment 24 from being in an over-cooling state.

At step S19, the control unit 120 then applies a control signal to the refrigerating compartment heater driving unit 132 of the heater driving unit 130 in order to execute the defrosting operation for removing frost formed on the refrigerating compartment evaporator 40.

Based on the control signal from the control unit 120, the refrigerating compartment heater driving unit 132 drives the refrigerating compartment evaporator's heater 47. Accordingly, the frost formed on the refrigerating compartment evaporator 40 is removed.

While the refrigerating compartment evaporator's heater 47 is generating heat, the temperature of the refrigerant passing through the refrigerating compartment evaporator 40 is sensed by the refrigerating compartment conduit temperature sensing unit 142 of the conduit temperature sensing unit 140. The resultant data from the refrigerating compartment conduit temperature sensing unit 142 is then sent to the control unit 120. This procedure is executed at step S20.

At step S21, the control unit 120 then determines whether or not the conduit temperature P2 of the refrigerating compartment evaporator 40 sensed by the refrigerating compartment conduit temperature sensing unit 142 is higher than a predetermined temperature Prs (namely, a defrosting ending temperature capable of completely removing frost formed on the refrigerating compartment evaporator 40) stored in the control unit 120. When the conduit temperature P2 of the refrigerating compartment evaporator 40 is lower than the predetermined temperature Prs (namely, if NO), it is determined that the frost on the refrigerating compartment evaporator 40 has been incompletely removed. In this case, the procedure returns to step S19. The procedure from step S19 is repeatedly executed.

On the other hand, when the conduit temperature P2 of the refrigerating compartment evaporator 40 is determined at step S21 as being higher than the predetermined temperature Prs (namely, if YES), it is determined that the frost on the refrigerating compartment evaporator 40 has been completely removed. In this case, the procedure proceeds to step S26. At step S26, the control unit 120 sends a control signal to the refrigerating compartment heater driving unit 132 of the heater driving unit 130 in order to stop the generation of heat from the refrigerating compartment evaporator's heater 47.

Based on the control signal from the control unit 120, the refrigerating compartment heater driving unit 132 stops the driving of the refrigerating compartment evaporator's heater 471 thereby stopping the defrosting operation of the refrigerating compartment evaporator 40.

Thereafter, it is determined at step S23 whether or not a predetermined pause time (namely, a predetermined delay time (for example, about 10 minutes) for protecting the compressor 56) has elapsed after the defrosting operation for the refrigerating compartment 24. Where the predetermined pause time has not elapsed yet (namely, if NO), the procedure returns to step S27. The procedure from step S27 is repeated until the predetermined pause time elapses.

Where the predetermined pause time has elapsed (namely, if YES), the compressor 56 is driven to supply cold air to the refrigerating compartment 24. In this case, the compressor 56 is not damaged because it paused sufficiently.

On the other hand, when the internal temperature Tr of the refrigerating compartment 24 is determined at step S11 as being Lower than the desired temperature Trs (namely, if NO), the procedure proceeds to step S24. At step 24, the drive time Cr of the refrigerating compartment fan 44 counted by the timer included in the control unit 120 is cleared. Thereafter, the operation of the refrigerator is completed.

Hereinafter, a method for controlling the defrosting operation of the refrigerator in accordance with a second embodiment of the present invention will be described.

Figure 7A:
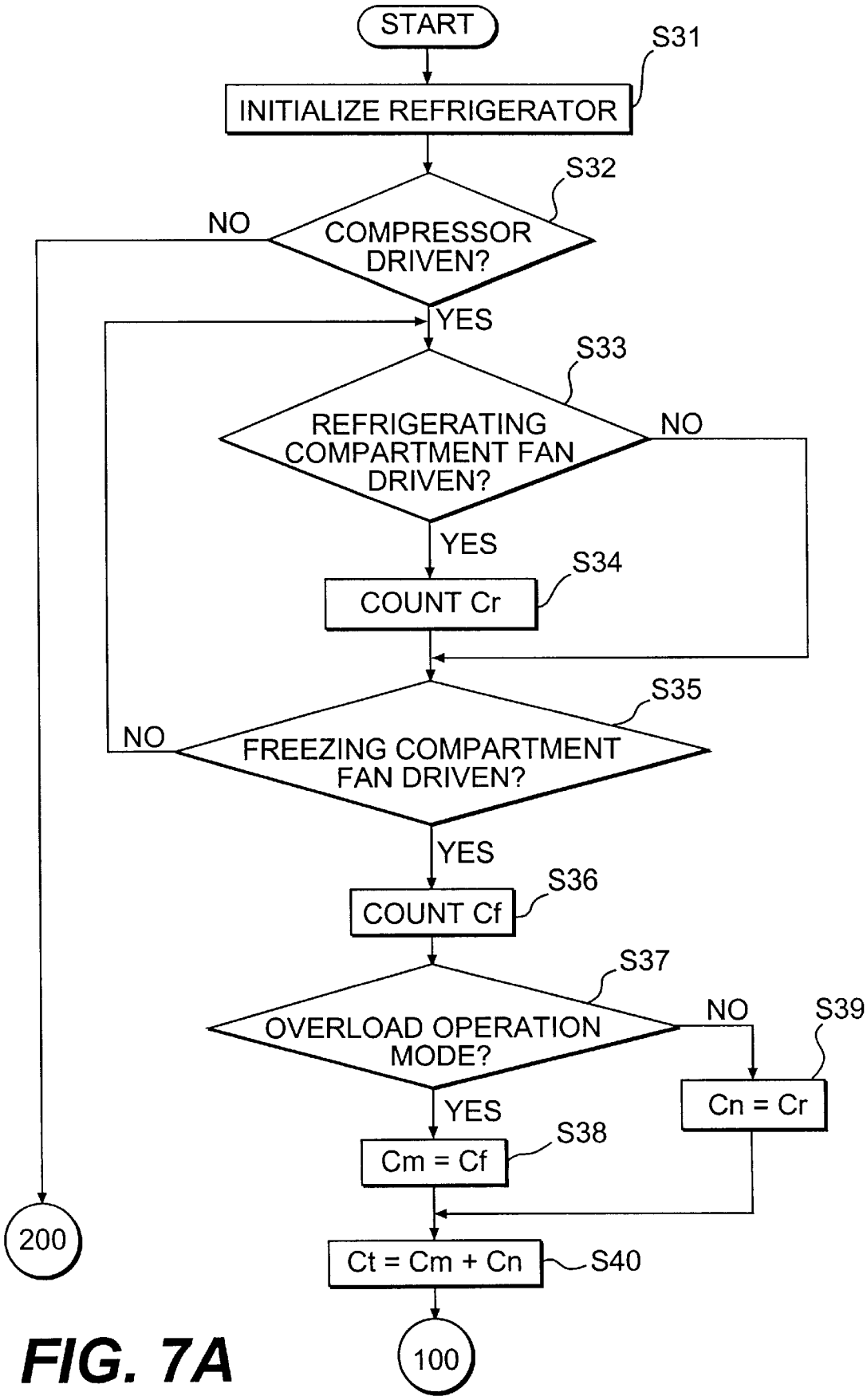
FIGS. 7A to 7C are flow charts respectively illustrating the sequence of a method for controlling the defrosting operation of the refrigerator in accordance with a second embodiment of the present invention.
Figure 7B:
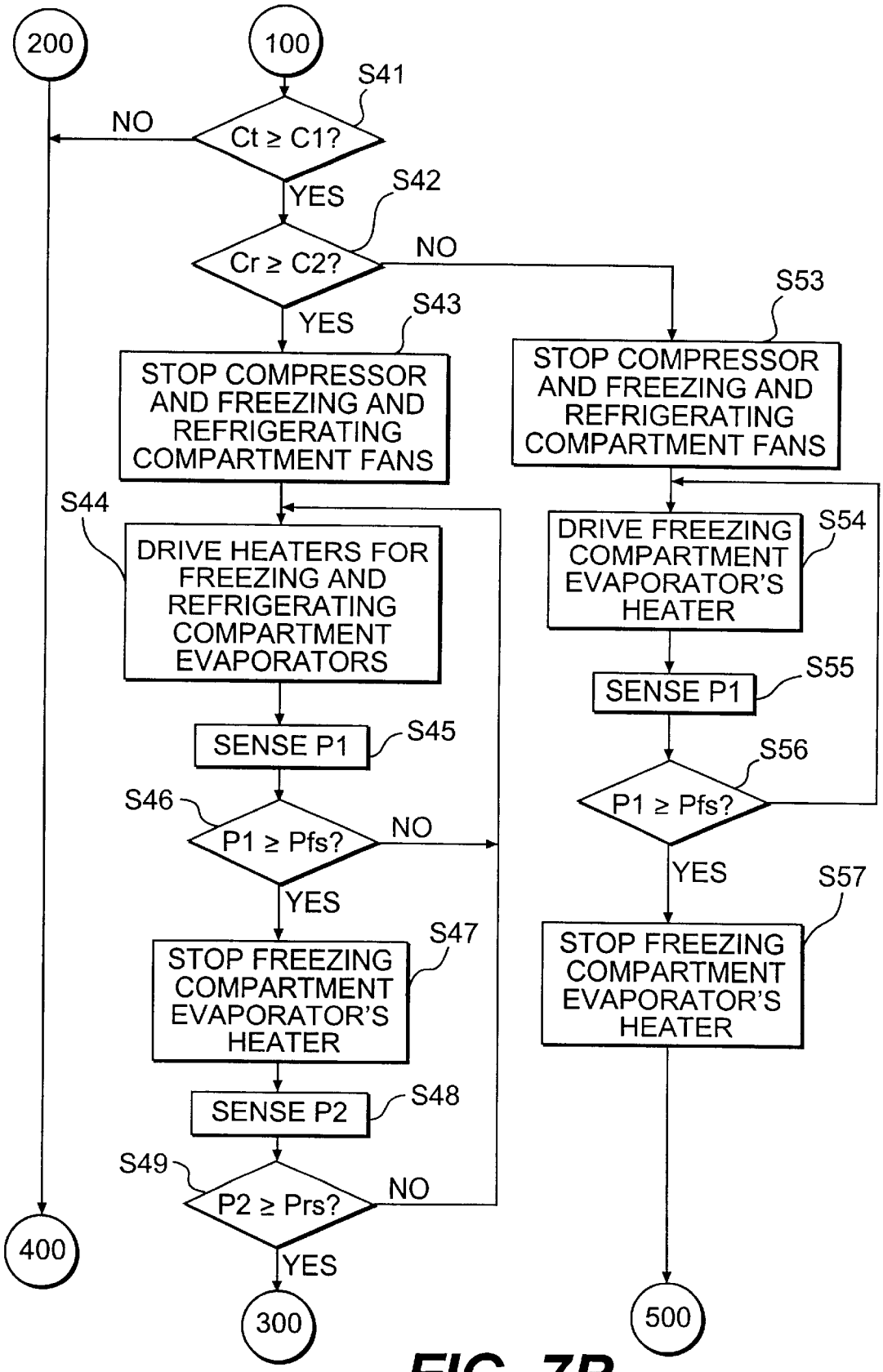
Figure 7C:
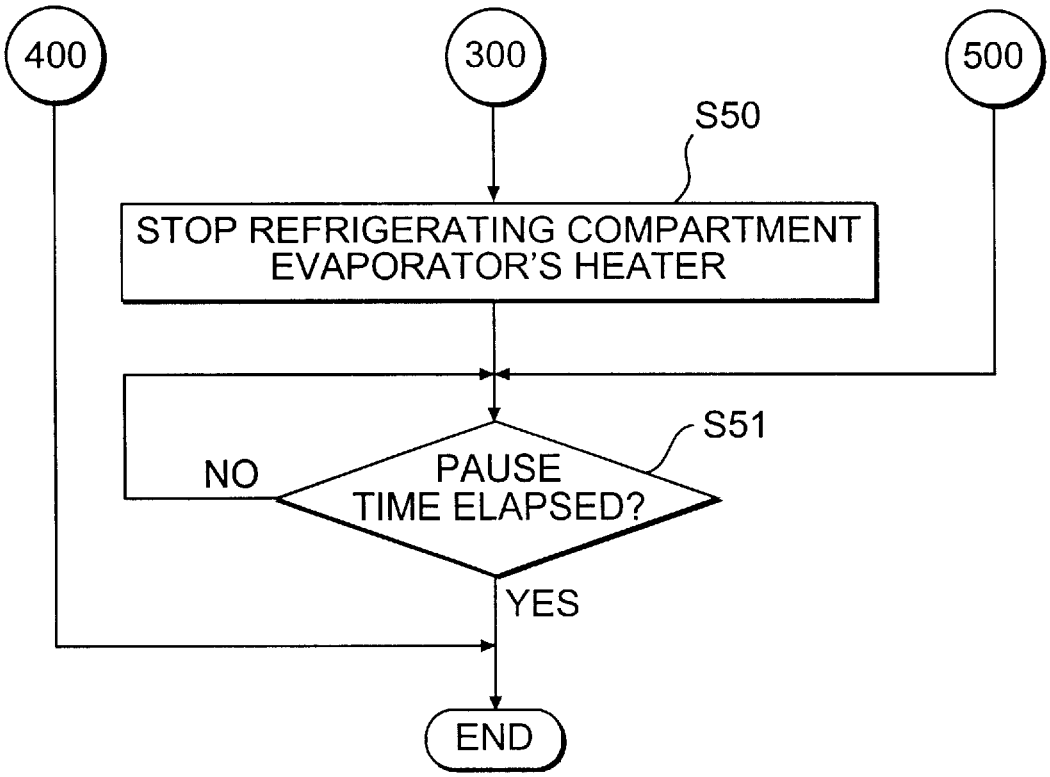

FIGS. 7A to 7C are flow charts respectively illustrating the sequence of the procedure for controlling the defrosting operation of the refrigerator in accordance with the second embodiment of the present invention.

Once the refrigerator is powered, the DC power supply unit 90 converts a source voltage received from a commercial AC power source at the AC power input stage (not shown) into a DC voltage with a voltage level required to drive various units of the refrigerator. The DC voltage from the DC power supply unit 90 is then applied to the control unit 120 as well as various driving circuits.

At step S31 of FIG. 7A, the control unit 120 initializes the refrigerator in response to the DC voltage received from the DC power supply unit 90 in order to operate the refrigerator. At step S32, it is determined whether or not the compressor 56 is being driven. This determination is made when the internal temperature of the freezing compartment 22 or refrigerating compartment 24 is higher than a desired temperature set by the user using the temperature setting unit 100.

When it is determined at step S32 that the compressor 56 is being driven (namely, if YES), the procedure proceeds to step S33. At step S33, it is determined that the refrigerating compartment fan 44 is being driven. Where the refrigerating compartment fan 44 is being driven (namely, if YES), step S34 is executed to count the drive time Cr of the refrigerating compartment fan 44 by the timer included in the control unit 120.

Subsequently, it is determined at step S35 whether or not the freezing compartment fan 30 is being driven. When the freezing compartment fan 30 is not driven (namely, if NO), the procedure returns to step S33. The procedure from step S33 is then repeatedly executed.

Where it is determined at step S35 that the freezing compartment fan 30 is being driven (namely, if YES), step S36 is executed. At step S36, the drive time Cf of the freezing compartment fan 30 is counted by a timer included in the control unit 120. Thereafter, the procedure proceeds to step S37 to determine whether or not the operation mode of the refrigerator corresponds to the overload operation mode.

When the operation mode of the refrigerator is determined at step S37 as corresponding to the overload operation mode (namely, if YES), the procedure proceeds to step S38. At step S38, the drive time Cf of the freezing compartment fan 30 counted at step S36 is set as the drive time Cm of the compressor 56 for the freezing operation.

On the other hand, where the operation mode of the refrigerator is determined at step S37 as not corresponding to the overload operation mode (namely, if NO), the procedure proceeds to step S39. At step S39, the drive time Cr of the refrigerating compartment fan 44 counted at step S34 is set as the drive time Cn of the compressor 56 for the refrigerating operation.

Thereafter, the total drive time Ct of the compressor 56 is calculated at step S40 by adding the drive time Cn derived at step S39 to the drive time Cm derived at step S38. It is then determined at step S41 of FIG. 7B whether or not the total drive time Ct of the compressor 56 is more than a predetermined time C1 (the total drive time (for example, 10 hours) of the compressor 56 causing the freezing compartment evaporator 26 to be frosted) stored in the control unit 120.

Where the total drive time Ct of the compressor 56 is determined at step S41 as being more than the predetermined time C1 (namely, if YES), it is determined that the freezing compartment evaporator 26 should be defrosted (that is, it is under a defrost requiring condition). Upon defrosting the freezing compartment evaporator 26, the refrigerating compartment evaporator 40 is simultaneously defrosted. To this end, it is necessary to check the defrost requiring condition of the refrigerating compartment evaporator 40. Accordingly, it is determined at step S42 whether or not the drive time Cr of the refrigerating compartment fan 44 counted by the timer included in the control unit 120 is more than a predetermined time C2 (namely, the total drive time (for example, about 9 hours) of the compressor 56 causing the refrigerating compartment fan 40 to be frosted.

When the counted drive time Cr of the refrigerating compartment fan 44 is determined at step S42 as being more than the predetermined time C2 (namely, if YES), step S43 is executed to defrost both the freezing and refrigerating compartment evaporators 26 and 40. As step S43, the control unit 120 sends a control signal to the compressor driving unit 150 and the freezing and refrigerating compartment fan motor driving units 161 and 162 of the fan motor driving unit 160 in order to stop the cooling operation for the freezing and refrigerating compartments 22 and 24.

Based on the control signal from the control unit 120, the compressor driving unit 150 and the freezing and refrigerating compartment fan motor driving units 161 and 162 stop the compressor 56 and the freezing and refrigerating compartment fan motors 28 and 42, respectively. As a result, the freezing and refrigerating compartment fans 30 and 44 are stopped, thereby stopping the cooling operation for the freezing and refrigerating compartments 22 and 24.

At step S44, the control unit 120 then applies a control signal to both the freezing and refrigerating compartment heater driving units 131 and 132 of the heater driving unit 130 in order to execute the defrosting operation for removing frost formed on the freezing and refrigerating compartment evaporators 26 and 40.

Based on the control signal from the control unit 120, the freezing and refrigerating compartment heater driving units 131 and 132 drive the freezing and refrigerating compartment evaporator's heaters 33 and 47, respectively. Accordingly, the frost formed on the freezing and refrigerating compartment evaporators 26 and 40 is removed by heat generated at the freezing and refrigerating compartment evaporator's heaters 33 and 47.

At step S45, the conduit temperature P1 of the freezing compartment evaporator 26 being varied while the freezing compartment evaporator's heater 33 is generating heat, namely, the temperature of the refrigerant passing through the freezing compartment evaporator 26 is sensed by the freezing compartment conduit temperature sensing unit 141 of the conduit temperature sensing unit 140.

At step S46, the control unit 120 then determines whether or not the conduit temperature P1 of the freezing compartment evaporator 26 sensed by the freezing compartment conduit temperature sensing unit 141 is higher than a predetermined temperature Pfs (namely, a defrosting ending temperature capable of completely removing frost formed on the freezing compartment evaporator 26) stored in the control unit 120. When the conduit temperature P1 of the freezing compartment evaporator 26 is lower than the predetermined temperature Pfs (namely, if NO), it is determined that the frost on the freezing compartment evaporator 40 has been incompletely removed. In this case, the procedure returns to step S44. The procedure from step S44 is repeatedly executed.

On the other hand, when the conduit temperature P1 of the freezing compartment evaporator 26 is determined at step S46 as being higher than the predetermined temperature Pfs (namely, if YES), it is determined that the frost on the freezing compartment evaporator 26 has been completely removed. In this case, the procedure proceeds to step S47. At step S47, the control unit 120 sends a control signal to the freezing compartment heater driving unit 131 of the heater driving unit 130 in order to stop the generation of heat from the freezing compartment evaporator's heater 33.

Based on the control signal from the control unit 120, the freezing compartment heater driving unit 131 stops the driving of the freezing compartment evaporator's heater 33, thereby stopping the defrosting operation for the freezing compartment 22.

Thereafter, the refrigerating compartment conduit temperature sensing unit 142 of the conduit temperature sensing unit 140 senses, at step S48, the conduit temperature P2 of the refrigerating compartment evaporator 40, namely, the temperature of the refrigerant passing through the refrigerating compartment evaporator 40 while the refrigerating compartment evaporator's heater 47 is generating heat. The resultant data from the refrigerating compartment conduit temperature sensing unit 142 is sent to the control unit 120.

At step S49, the control unit 120 then determines whether or not the conduit temperature P2 of the refrigerating compartment evaporator 40 sensed by the refrigerating compartment conduit temperature sensing unit 142 is higher than a predetermined temperature Prs (namely, a defrosting ending temperature capable of completely removing frost formed on the refrigerating compartment evaporator 40) stored in the control unit 120. When the conduit temperature P2 of the refrigerating compartment evaporator 40 is lower than the predetermined temperature Prs (namely, if NO), it is determined that the frost on the refrigerating compartment evaporator 40 has been incompletely removed. In this case, the procedure returns to step S44. The procedure from step S44 is repeatedly executed.

On the other hand, when the conduit temperature P2 of the refrigerating compartment evaporator 40 is determined at step S49 as being higher than the predetermined temperature Prs (namely, if YES), it is determined that the frost on the refrigerating compartment evaporator 40 has been completely removed. In this case, the procedure proceeds to step S50 of FIG. 7C. At step S50, the control unit 120 sends a control signal to the refrigerating compartment heater driving unit 132 of the heater driving unit 130 in order to stop the generation of heat from the refrigerating compartment evaporator's heater 47.

Based on the control signal from the control unit 120, the refrigerating compartment heater driving unit 132 stops the generation of heat from the refrigerating compartment evaporator's heater 47, thereby stopping the defrosting operation for the refrigerating compartment 24.

Thereafter, it is determined at step S51 whether or not a predetermined pause time (namely, a predetermined delay time (for example, about 10 minutes) for protecting the compressor 56) has elapsed after the defrosting operation for the freezing and refrigerating compartments 22 and 24. Where the predetermined pause time has not elapsed yet (namely, if NO), the procedure returns to step S51. The procedure from step S51 is repeated until the predetermined pause time elapses.

Where the predetermined pause time has elapsed (namely, if YES), the compressor 56 is driven to execute the freezing operation for the freezing compartment 22 or the refrigerating operation for the refrigerating compartment 24. In this case, the compressor 56 is not damaged because it paused sufficiently.

On the other hand, when it is determined at step S32 that the compressor 56 is not driven (namely, if YES), it is determined that neither the freezing compartment 22 nor the refrigerating compartment 24 is under the defrost requiring condition. In this case, the control unit 120 does not execute any control for the defrosting operation of the refrigerator. Where the total drive time Ct of the compressor 56 is determined at step S41 as being less than the predetermined time C1 (namely, if NO), neither the freezing compartment 22 nor the refrigerating compartment 24 is under the defrost requiring condition. Accordingly, the control unit 120 does not execute any control for the defrosting operation for the refrigerator.

Where the drive time Cr of the refrigerating compartment fan 44 is determined at step S42 as being less than the predetermined time C2 (namely, if NO), it is determined that the freezing compartment 22 requires the defrosting operation whereas the refrigerating compartment 22 does not require the defrosting operation. In this case, the procedure proceeds to step S53. At step 53, the control unit 120 applies a control signal for stopping the cooling operation for the freezing and refrigerating compartments 22 and 24 to the compressor driving unit 150 and the freezing and refrigerating compartment fan motor driving units 161 and 162 of the fan motor driving unit 160.

Based on the control signal from the control unit 120, the compressor driving unit 150 and the freezing and refrigerating compartment fan motor driving units 161 and 162 stop the compressor 56 and the freezing and refrigerating compartment fan motors 28 and 42, respectively. As a result, the freezing and refrigerating compartment fans 30 and 44 are stopped, thereby stopping the cooling operation for the freezing and refrigerating compartments 22 and 24.

At step S54, the control unit 120 then applies a control signal to the freezing compartment heater driving unit 131 of the heater driving unit 130 in order to execute the defrosting operation for removing frost formed on the freezing compartment evaporator 26.

Based on the control signal from the control unit 120, the freezing compartment heater driving unit 131 drives the freezing compartment evaporator's heater 33. Accordingly, the frost formed on the freezing compartment evaporator 26 is removed by heat generated at the freezing compartment evaporator's heater 33.

At step S55, the conduit temperature P1 of the freezing compartment evaporator 26 being varied while the freezing compartment evaporator's heater 33 is generating heat is sensed by the freezing compartment conduit temperature sensing unit 141 of the conduit temperature sensing unit 140. The resultant data from the freezing compartment conduit temperature sensing unit 141 is sent to the control unit 120. At step S56, the control unit 120 then determines whether or not the conduit temperature P1 of the freezing compartment evaporator 26 sensed by the freezing compartment conduit temperature sensing unit 141 is higher than a predetermined temperature Pfs stored in the control unit 120.

When the conduit temperature P1 of the freezing compartment evaporator 26 is determined at step S56 as being lower than the predetermined temperature Pfs (namely, if NO), it is determined that the frost on the freezing compartment evaporator 40 has been incompletely removed. In this case, the procedure returns to step S54. The procedure from step S54 is repeatedly executed.

On the other hand, where the conduit temperature P1 of the freezing compartment evaporator 26 is determined at step S56 as being higher than the predetermined temperature Pfs (namely, if YES), it is determined that the frost on the freezing compartment evaporator 26 has been completely removed. In this case, the procedure proceeds to step S57. At step S57, the control unit 120 sends a control signal to the freezing compartment heater driving unit 131 of the heater driving unit 130 in order to stop the driving of the freezing compartment evaporator's heater 33.

Based on the control signal from the control unit 120, the freezing compartment heater driving unit 131 stops the driving of the freezing compartment evaporator's heater 33, thereby causing the heater 33 to generate heat no longer. As a result, the defrosting operation for the freezing compartment 22 is stopped. Thereafter, it is determined at step S51 whether or not the predetermined pause time has elapsed after the defrosting operation for the freezing compartment 22. The procedure from step S51 is then repeated.

Now, a method for controlling the defrosting operation of the refrigerator in accordance with a third embodiment of the present invention will be described.

Figure 8A:
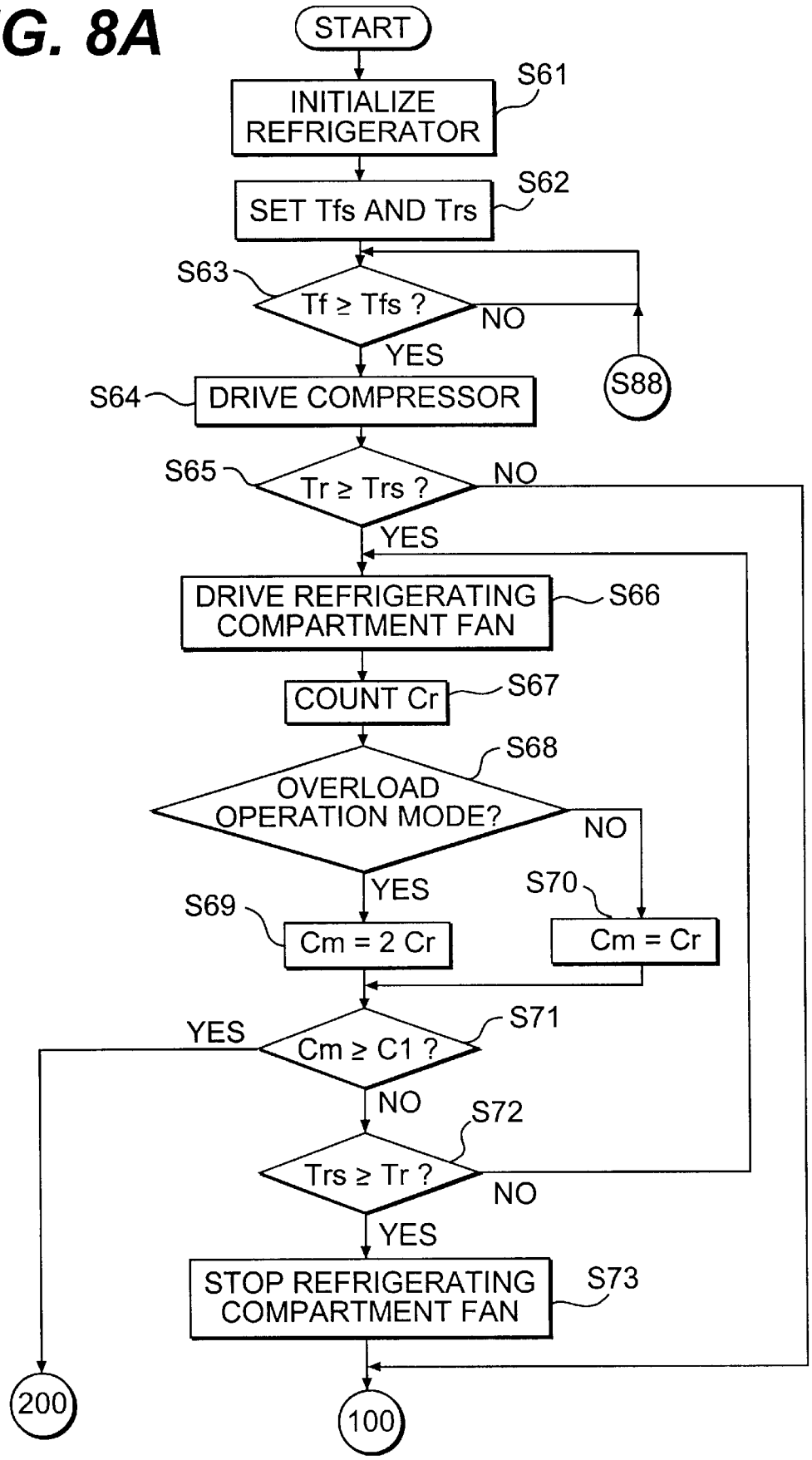
FIGS. 8A and 8B are flow charts respectively illustrating the sequence of a method for controlling the defrosting operation of the refrigerator in accordance with a third embodiment of the present invention.
Figure 8B:
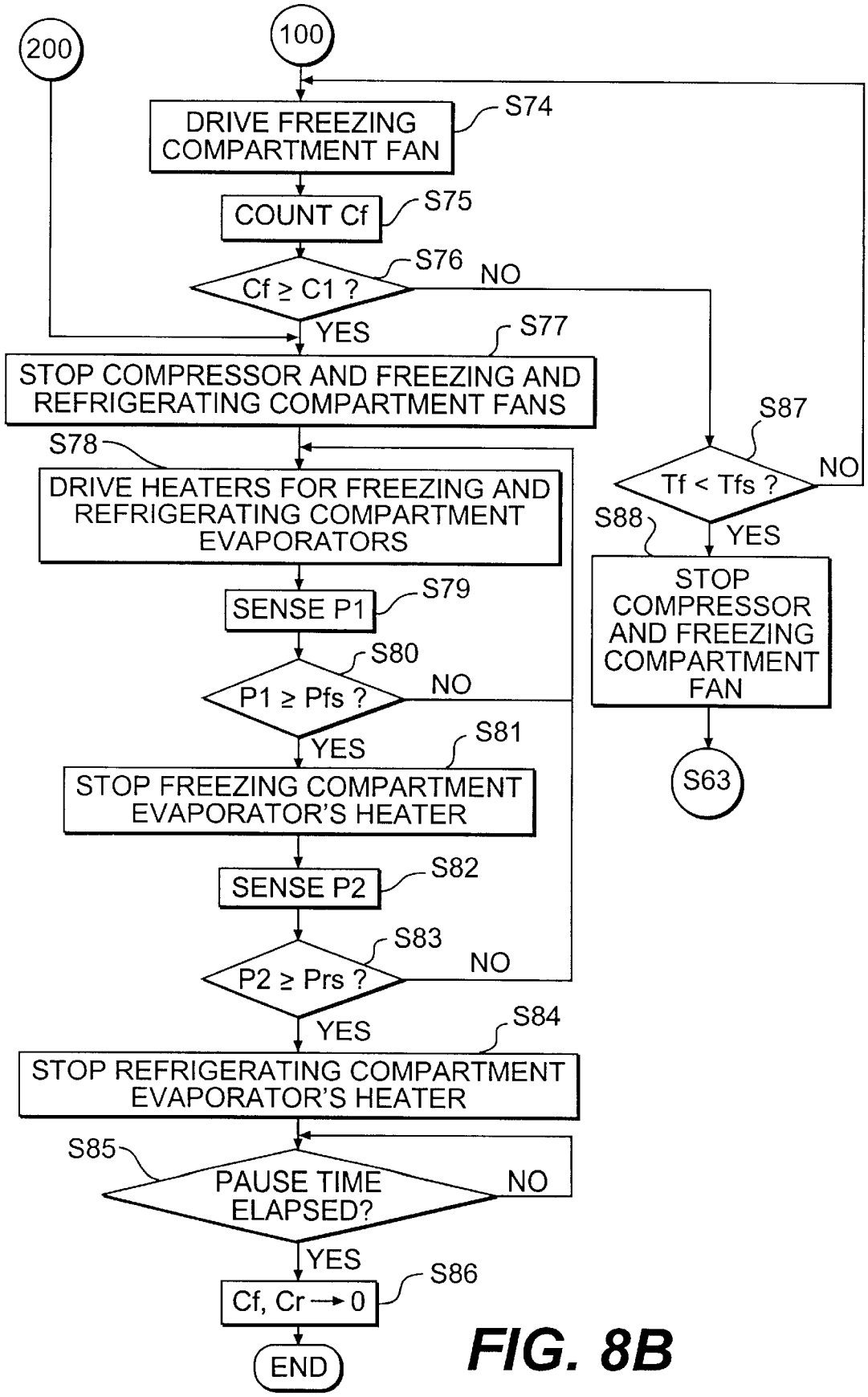

FIGS. 8A and 8B are flow charts respectively illustrating the sequence of the procedure for controlling the defrosting operation of the refrigerator in accordance with the third embodiment of the present invention.

Once the refrigerator is powered, the DC power supply unit 90 converts a source voltage received from a commercial AC power source at the AC power input stage (not shown) into a DC voltage with a voltage level required to drive various units of the refrigerator. The DC voltage from the DC power supply unit 90 is then applied to the control unit 120 as well as various driving circuits.

At step S61 of FIG. 8A, the control unit 120 initializes the refrigerator in response to the DC voltage received from the DC power supply unit 90 in order to operate the refrigerator. At step S62, the desired internal temperatures Tfs and Trs of the freezing and refrigerating compartments 22 and 24 are set using the freezing and refrigerating compartment temperature setting units.101 and 102 of the temperature setting unit 100.

The procedure then proceeds to step S63. At step S63, it is determined whether or not the internal temperature Tf of the freezing compartment 22 sensed by the freezing compartment temperature sensing unit 111 is higher than the desired temperature Tfs set by the freezing compartment temperature setting unit 101.

Where the internal temperature Tf of the freezing compartment 22 is determined at step S63 as being lower than the desired temperature Tfs (namely, if NO), the procedure returns to step S63. The procedure from step S63 is then repeated while continuously sensing the internal temperature Tf of the freezing compartment 22 until the temperature Tf is higher than the desired temperature Tfs.

On the other hand, when the current internal temperature Tf of the freezing compartment 22 is determined at step S63 as being higher than the desired temperature Tfs (namely, if YES), the procedure proceeds to step S64. At step S64, the control unit 120 applies a control signal for driving the compressor 56 to the compressor driving unit 150. Based on the control signal, the compressor 56 is driven.

Subsequently, it is determined at step S65 whether the current internal temperature Tr of the refrigerating compartment 24 is higher than the desired temperature Trs.

Where the internal temperature Tr of the refrigerating compartment 24 is higher than the desired temperature Trs, the procedure proceeds to step S66. At step S66, the control unit 120 applies a control signal to the refrigerating compartment fan motor driving unit 162 of the fan motor driving unit 160 in order to first cool the refrigerating compartment 24. Based on the control signal from the control unit 120, the refrigerating compartment fan motor 42 is driven, thereby rotating the refrigerating compartment fan 44 coupled to the rotating shaft of the refrigerating compartment fan motor 42. As a result, the refrigerating compartment 24 is cooled.

Thereafter, the procedure proceeds to step S67 to count the drive time Cr of the refrigerating compartment fan 44 by the timer included in the control unit 120.

Where the compressor 56 and refrigerating compartment fan motor 42 are driven while the freezing compartment fan motor 28 is being stopped, only the refrigerating compartment evaporator 40 can carry out a heat exchange between refrigerant and ambient air. That is, refrigerant compressed to a gaseous phase of high temperature and pressure is discharged out of the compressor 56 toward the assistant condenser 60. While passing through the assistant condenser 60, the refrigerant evaporates water collected in the evaporating dish 54. The refrigerant is then introduced in the main condenser 58. While passing through the main condenser 58, the refrigerant carries out a heat exchange with ambient air in accordance with the natural or forced convection phenomenon, so that it is cooled to have a liquid phase under low temperature and high pressure. That is, the refrigerant is liquefied.

The liquid-phase refrigerant of low temperature and high pressure, which has been liquefied in the main condenser 58, then passes through the capillary tube 57. By the capillary tube 57, the refrigerant is changed to that of low temperature and pressure so that it can be easily evaporated. The refrigerant emerging from the capillary tube 57 is then introduced in the freezing and refrigerating compartment evaporators 26 and 40.

While passing through the freezing and refrigerating compartment evaporators 26 and 40, each of which is constituted by a plurality of pipes, the refrigerant of low temperature and pressure carries out a heat exchange with air being blown into the freezing and refrigerating compartments 22 and 24. By this heat exchange, the refrigerant is vaporized while cooling the air. The resultant gaseous refrigerant flows of low temperature and pressure respectively emerging from the freezing and refrigerating compartment evaporators 26 and 40 are then introduced in the compressor 56. Thus, the refrigerant circulates the refrigerating cycle of FIG. 4 repeatedly.

In the above case, however, there is no flow of air being blown toward the freezing compartment 22 because the freezing compartment fan 30 is not driven. Accordingly, the heat exchange is carried out only at the refrigerating compartment evaporator 40.

The cold air heat-exchanged with the refrigerant by the refrigerating compartment evaporator 40 is blown by the rotating force of the refrigerating compartment fan 44 and guided by the refrigerating compartment duct member 46 so that it is discharged into the refrigerating compartment 24 through the cold air discharge port 46*a*. As a result, the refrigerating compartment 24 is cooled.

While the compressor 56 and refrigerating compartment fan 44 are being driven, the refrigerating compartment temperature sensing unit 113 senses the current internal temperature Tr of the refrigerating compartment 24 and sends the resultant data to the control unit 120.

At step S67, the drive time Cr of the refrigerating compartment fan 44 is counted by the timer included in the control unit 120. Thereafter, the procedure proceeds to step S68 to determine whether or not the operation mode of the refrigerator corresponds to the overload operation mode, that is, whether the number of times the refrigerating compartment door has been opened is more than a predetermined value. When the operation mode of the refrigerator is determined at step S68 as corresponding to the overload operation mode (namely, if YES), the procedure proceeds to step S69. At step S69, the drive time Cr of the refrigerating compartment fan 44 counted at step S67 is multiplied by 2. The resultant value is set as the drive time Cm of the compressor 56. For the drive time Cm, the refrigerator is operated.

On the other hand, where the operation mode of the refrigerator is determined at step S68 as not corresponding to the overload operation mode (namely, if NO), the procedure proceeds to step S70. At step S70, the drive time Cr of the refrigerating compartment fan 44 counted at step S67 is set as the drive time Cm of the compressor 56.

Thereafter, it is determined at step S71 whether or not the drive time Cm of the compressor 56 is more than a predetermined time C1 (the drive time (for example, 10 hours) of the compressor 56 causing the refrigerating compartment evaporator 40 to be frosted) stored in the control unit 120.

Where the drive time Cm of the compressor 56 is determined at step S71 as being less than the predetermined time C1 (namely, if NO), step S72 is executed to determine whether or not the current internal temperature Tr of the refrigerating compartment 24 sensed by the refrigerating compartment temperature sensing unit 113 is lower than the desired temperature Trs set by the user.

When the current internal temperature Tr of the refrigerating compartment 24 is determined at step S72 as being higher than the desired temperature Trs, the procedure proceeds to step S66. The procedure from step S66 is repeated to continuously cool the refrigerating compartment 24.

On the other hand, when the current internal temperature Tr of the refrigerating compartment 24 is determined at step S72 as being lower than the desired temperature Trs, the control unit 120 applies, at step S73, a control signal for stopping the cooling operation for the refrigerating compartment 24 to the refrigerating compartment fan motor driving unit 162 of the fan motor driving unit 160. Based on the control signal, the refrigerating compartment fan motor 42 is stopped, thereby stopping the cooling operation for the refrigerating compartment 24.

Thereafter, the procedure proceeds to step S74 of FIG. 8B to cool the freezing compartment 22. At step S74, the control unit 120 applies a control signal to the freezing compartment fan motor driving unit 161 of the fan motor driving unit 160. Based on the control signal from the control unit 120, the freezing compartment fan motor 28 is driven, thereby rotating the freezing compartment fan 30 coupled to the rotating shaft of the freezing compartment fan motor 28. At step S75, the drive time Cf of the freezing compartment fan 30 is then counted by the timer included in the control unit 120.

Where the freezing compartment fan motor 28 is driven while the refrigerating compartment fan motor 42 is being stopped, only the freezing compartment evaporator 26 can carry out a heat exchange between refrigerant and ambient air. That is, refrigerant compressed to a gaseous phase of high temperature and pressure is discharged out of the compressor 56 toward the assistant condenser 60. While passing through the assistant condenser 60, the refrigerant evaporates water contained in the evaporating dish 54. The refrigerant is then introduced in the main condenser 58. While passing through the main condenser 58, the refrigerant carries out a heat exchange with ambient air in accordance with the natural or forced convection phenomenon, so that it is cooled to have a liquid phase under low temperature and high pressure. That is, the refrigerant is liquefied.

The liquid-phase refrigerant of low temperature and high pressure, which has been liquefied in the main condenser 58, then passes through the capillary tube 57. By the capillary tube 57, the refrigerant is changed to that of low temperature and pressure so that it can be easily evaporated. The refrigerant emerging from the capillary tube 57 is then introduced in the freezing and refrigerating compartment evaporators 26 and 40.

While passing through the freezing and refrigerating compartment evaporators 26 and 40, each of which is constituted by a plurality of pipes, the refrigerant of low temperature and pressure carries out a heat exchange with air being blown into the freezing and refrigerating compartments 22 and 24. By this heat exchange, the refrigerant is vaporized while cooling the air. The resultant gaseous refrigerant flows of low temperature and pressure respectively emerging from the freezing and refrigerating compartment evaporators 26 and 40 are then introduced in the compressor 56. Thus, the refrigerant circulates the refrigerating cycle of FIG. 4 repeatedly.

In the above case, however, there is no flow of air being blown toward the refrigerating compartment 24 because the refrigerating compartment fan 44 is not driven. Accordingly, the heat exchange is carried out only at the freezing compartment evaporator 26.

The cold air heat-exchanged with the refrigerant by the freezing compartment evaporator 26 is blown by the rotating force of the freezing compartment fan 30 and guided by the freezing compartment duct member 32 so that it is discharged into the freezing compartment 22 through the cold air discharge port 32*a*. As a result, the freezing compartment 22 is cooled.

Where the freezing compartment fan 30 is driven along with the compressor 56, thereby carrying out the cooling operation for the freezing compartment 22 for a certain period of time, the internal temperature Tf of the freezing compartment 22 is gradually lowered. This internal temperature Tf of the freezing compartment 22 is sensed by the freezing compartment temperature sensing unit 111 of the temperature sensing unit 110. The resultant data from the freezing compartment temperature sensing unit 111 is then applied to the control unit 120.

At step S76, it is then determined whether or not the drive time Cf of the freezing compartment fan 30 counted by the timer included in the control unit 120 is more than the predetermined time C1 stored in the control unit 120.

When the counted drive time Cf of the freezing compartment fan 30 is determined at step S76 as being more than the predetermined time C1 (namely, if YES), step S77 is executed to defrost both the freezing and refrigerating compartment evaporators 26 and 40. As step S77, the control unit 120 sends a control signal to the compressor driving unit 150 and the freezing and refrigerating compartment fan motor driving units 161 and 162 of the fan motor driving unit 160 in order to stop the cooling operation for the freezing and refrigerating compartments 22 and 24.

Based on the control signal from the control unit 120, the compressor driving unit 150 and the freezing and refrigerating compartment fan motor driving units 161 and 162 stop the compressor 56 and the freezing and refrigerating compartment fan motors 28 and 42, respectively. As a result, the freezing and refrigerating compartment fan motors 28 and 42 are stopped, thereby stopping the cooling operation for the freezing and refrigerating compartments 22 and 24.

At step S78, the control unit 120 then applies a control signal to both the freezing and refrigerating compartment heater driving Units 131 and 132 of the heater driving unit 130 in order to execute the defrosting operation for removing frost formed on the freezing and refrigerating compartment evaporators 26 and 40. Based on the control signal from the control unit 120, the freezing and refrigerating compartment heater driving units 131 and 132 drive the freezing and refrigerating compartment evaporator's heaters 33 and 47, respectively. Accordingly, the frost formed on the freezing and refrigerating compartment evaporators 26 and 40 is removed by heat generated at the freezing and refrigerating compartment evaporator's heaters 33 and 47.

At step S79, the conduit temperature P1 of the freezing compartment evaporator 26, that is, the temperature P1 of the refrigerant passing through the freezing compartment evaporator 26 is sensed by the freezing compartment conduit temperature sensing unit 141 of the conduit temperature sensing unit 140. The resultant data is sent to the control unit 120. At step S80, the control unit 120 then determines whether or not the conduit temperature P1 of the freezing compartment evaporator 26 is higher than a predetermined temperature Pfs (namely, a defrosting ending temperature capable of completely removing frost formed on the freezing compartment evaporator 26) stored in the control unit 120. When the conduit temperature P1 of the freezing compartment evaporator 26 is lower than the predetermined temperature Pfs (namely, if NO), it is determined that the frost on the freezing compartment evaporator 40 has been incompletely removed. In this case, the procedure returns to step S78. The procedure from step S78 is repeated until the conduit temperature P1 of the freezing compartment evaporator 26 reaches the predetermined temperature Pfs.

On the other hand, when the conduit temperature P1 of the freezing compartment evaporator 26 is determined at step S80 as being higher than the predetermined temperature Pfs (namely, if YES), it is determined that the frost on the freezing compartment evaporator 26 has been completely removed. In this case, the procedure proceeds to step S81. At step S81, the control unit 120 sends a control signal to the freezing compartment heater driving unit 131 of the heater driving unit 130 in order to stop the generation of heat from the freezing compartment evaporator's heater 33. Based on the control signal from the control unit 120, the freezing compartment heater driving unit 131 stops the driving of the freezing compartment evaporator's heater 33, thereby stopping the defrosting operation for the freezing compartment 22.

Thereafter, the refrigerating compartment conduit temperature sensing unit 142 of the conduit temperature sensing unit 140 senses, at step S82, the conduit temperature P2 of the refrigerating compartment evaporator 40, namely, the temperature of the refrigerant passing through the refrigerating compartment evaporator 40. The resultant data is sent to the control unit 120. At step S83, the control unit 120 then determines whether or not the conduit temperature P2 of the refrigerating compartment evaporator 40 is higher than a predetermined temperature Prs (namely, a defrosting ending temperature capable of completely removing frost formed on the refrigerating compartment evaporator 40) stored in the control unit 120. When the conduit temperature P2 of the refrigerating compartment evaporator 40 is lower than the predetermined temperature Prs (namely, if NO), it is determined that the frost on the refrigerating compartment evaporator 40 has been incompletely removed. In this case, the procedure returns to step S78. The procedure from step S78 is repeatedly executed until the conduit temperature P2 of the refrigerating compartment evaporator 40 reaches the predetermined temperature Prs.

On the other hand, when the conduit temperature P2 of the refrigerating compartment evaporator 40 is determined at step S49 as being higher than the predetermined temperature Prs (namely, if YES), it is determined that the frost on the refrigerating compartment evaporator 40 has been completely removed. In this case, the procedure proceeds to step S84. At step S84, the control unit 120 sends a control signal to the refrigerating compartment heater driving unit 132 of the heater driving unit 130 in order to stop the generation of heat from the refrigerating compartment evaporator's heater 47. Based on the control signal from the control unit 120, the refrigerating compartment heater driving unit 132 stops the generation of heat from the refrigerating compartment evaporator's heater 47, thereby stopping the defrosting operation for the refrigerating compartment 24.

Thereafter, it is determined at step S85 whether or not a predetermined pause time (namely, a predetermined delay time (for example, about 10 minutes) for protecting the compressor 56) has elapsed after the defrosting operation for the freezing and refrigerating compartments 22 and 24. Where the predetermined pause time has not elapsed yet (namely, if NO), the procedure from step S85 is repeated until the predetermined pause time elapses.

Where the predetermined pause time has elapsed (namely, if YES), the compressor 56 can be driven again. In this case, the compressor 56 is not damaged because it paused sufficiently. Accordingly, the control unit 120 stops the defrosting operation of the refrigerator and then clears, at step S86, the counted drive times Cf and Cr of the freezing and refrigerating compartment fans 30 and 44. Thus, the defrosting operation is completed.

On the other hand, when it is determined at step S76 that the drive time Cf of the freezing compartment fan 30 is less than the predetermined time C1 (namely, if NO), neither the freezing compartment 22 nor the refrigerating compartment 24 is under the defrost requiring condition. In this case, the procedure proceeds to step S87. At step S87, it is determined whether or not the current internal temperature Tf of the freezing compartment 22 sensed by the freezing compartment temperature sensing unit 111 of the temperature sensing unit 110 is lower than the predetermined temperature Tfs stored in the control unit 120. When the internal temperature Tf of the freezing compartment 22 is higher than the predetermined temperature Tfs (namely, if NO), the procedure returns to step S74 to continuously cool the freezing compartment 22. The procedure from step S74 is repeatedly executed.

When the internal temperature Tf of the freezing compartment 22 is determined at step S87 as being lower than the predetermined temperature Tfs (namely, if YES), the procedure proceeds to step S88. At step S88, the control unit 120 applies a control signal for stopping the cooling operation for the freezing compartment 22 to the compressor driving unit 150 and the freezing compartment fan motor driving unit 161 of the fan motor driving unit 160.

Based on the control signal from the control unit 120, the compressor driving unit 150 and freezing compartment fan motor driving unit 161 stop the compressor 56 and freezing compartment fan motor 28, respectively. As a result, the cooling operation for the freezing compartment 22 is completed. Thereafter, the procedure returns to step S63. The procedure from S63 is then repeated.

Hereinafter, a method for controlling the defrosting operation of the refrigerator in accordance with a fourth embodiment of the present invention will be described.

Figure 9A:
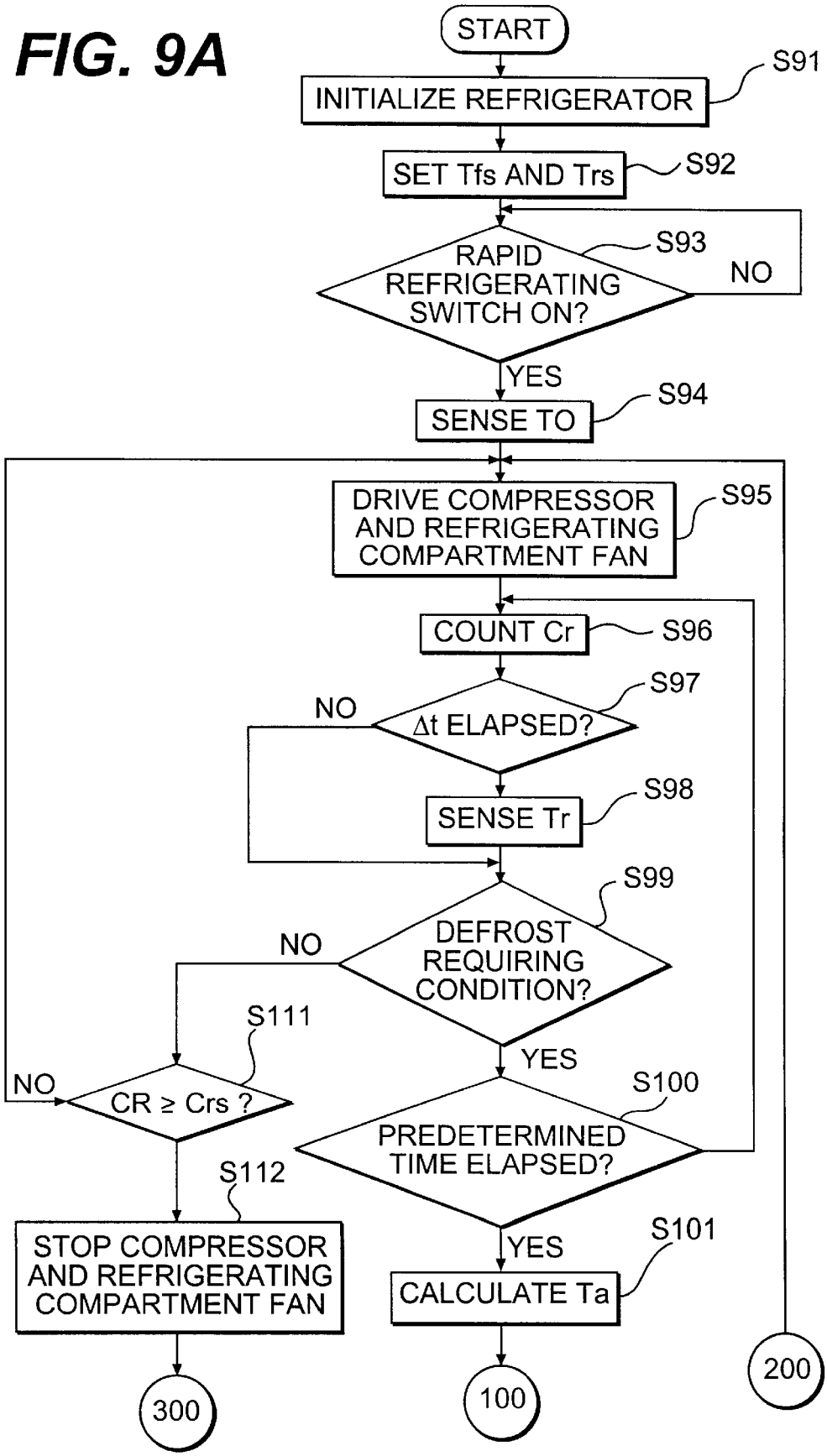
FIGS. 9A to 9B are flow charts respectively illustrating the sequence of a method for controlling the defrosting operation of the refrigerator in accordance with a fourth embodiment of the present invention.
Figure 9B:
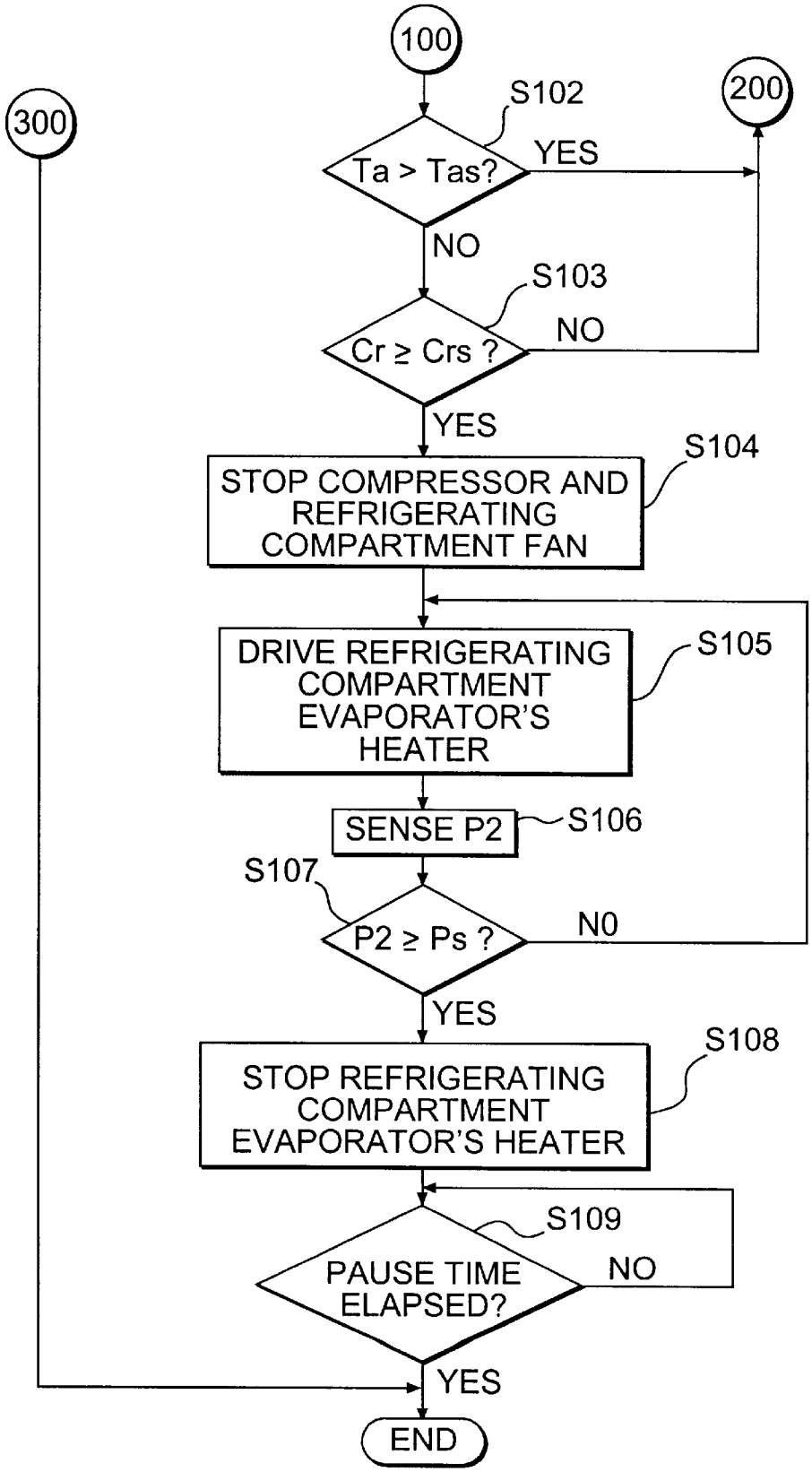

FIGS. 9A and 9B are flow charts respectively illustrating the sequence of the procedure for controlling the defrosting operation of the refrigerator in accordance with the fourth embodiment of the present invention.

Once the refrigerator is powered, the DC power supply unit 90 converts a source voltage received from a commercial AC power source at the AC power input stage (not shown) into a DC voltage with a voltage level required to drive various units of the refrigerator. The DC voltage from the DC power supply unit 90 is then applied to the control unit 120 as well as various driving circuits.

At step S91 of FIG. 9A, the control unit 120 initializes the refrigerator in response to the DC voltage received from the DC power supply unit 90 in order to operate the refrigerator. At step S92, the desired internal temperatures Tfs and Trs of the freezing and refrigerating compartments 22 and 24 are set by manipulating the freezing and refrigerating compartment temperature setting units 101 and 102 of the temperature setting unit 100. The procedure then proceeds to step S93 to determine whether or not the rapid refrigerating switch is in its ON state. When the rapid refrigerating switch is determined at step S93 as not being in its ON state (namely, if NO), the control unit 102 executes the procedure from the step S93 while controlling the refrigerator to standby for its rapid refrigerating operation.

When the rapid refrigerating switch is determined at step S93 as being in its ON state (namely, if YES), the procedure proceeds to step S94 to execute the rapid refrigerating operation for the refrigerating compartment 24. At step S94, the refrigerating compartment temperature sensing unit 112 of the temperature sensing unit 110 senses the internal temperature T0 of the refrigerating compartment 24 at the point of time when the rapid refrigerating operation begins. The resultant data is sent to the control unit 120. Thereafter, the procedure proceeds to step S95. At step S95, the control unit 120 applies a control signal for rapidly cooling the refrigerating compartment 24 to both the compressor driving unit 150 and the refrigerating compartment fan motor driving unit 162 of the fan motor driving unit 160. Based on the control signal, the refrigerating compartment fan motor 42 is driven, thereby rotating the refrigerating compartment fan 44 coupled to the rotating shaft thereof.

Where the compressor 56 and refrigerating compartment fan 44 are driven while the freezing compartment fan 30 is being stopped, only the refrigerating compartment evaporator 40 can carry out a heat exchange between refrigerant and ambient air. That is, refrigerant compressed to a gaseous phase of high temperature and pressure is discharged out of the compressor 56 toward the assistant condenser 60. While passing through the assistant condenser 60, the refrigerant evaporates water collected in the evaporating dish 54. The refrigerant is then introduced in the main condenser 58. While passing through the main condenser 58, the refrigerant carries out a heat exchange with ambient air in accordance with the natural or forced convection phenomenon, so that it is cooled to have a liquid phase under low temperature and high pressure. That is, the refrigerant is liquefied.

The liquid-phase refrigerant of low temperature and high pressure, which has been liquefied in the main condenser 58, then passes through the capillary tube 57. By the capillary tube 57, the refrigerant is changed to that of low temperature and pressure so that it can be easily evaporated. The refrigerant emerging from the capillary tube 57 is then introduced in the freezing and refrigerating compartment evaporators 26 and 40.

While passing through the freezing and refrigerating compartment evaporators 26 and 40, each of which is constituted by a plurality of pipes, the refrigerant of low temperature and pressure carries out a heat exchange with air being blown into the freezing and refrigerating compartments 22 and 24. By this heat exchange, the refrigerant is vaporized while cooling the air. The resultant gaseous refrigerant flows of low temperature and pressure respectively emerging from the freezing and refrigerating compartment evaporators 26 and 40 are then introduced in the compressor 56. Thus, the refrigerant circulates the refrigerating cycle of FIG. 4 repeatedly.

In the above case, however, there is no flow of air being blown toward the freezing compartment 22 because the freezing compartment fan 30 is not driven. Accordingly, no heat exchange is carried out at the freezing compartment evaporator 26. The heat exchange is carried out only at the refrigerating compartment evaporator 40.

The cold air heat-exchanged with the refrigerant by the refrigerating compartment evaporator 40 is blown by the rotating force of the refrigerating compartment fan 44 and guided by the refrigerating compartment duct member 46 so that it is discharged into the refrigerating compartment 24 through the cold air discharge port 46*a*. Thus, the rapid refrigerating operation for the refrigerating compartment 24 is executed.

The refrigerating compartment temperature sensing unit 112 senses the current internal temperature Tr of the refrigerating compartment 24 being varied during the rapid refrigerating operation for the refrigerating compartment 24 carried out by driving the compressor 56 and refrigerating compartment fan 44. The resultant data is sent to the control unit 120.

Subsequently, the procedure proceeds to step S96. At this step, the drive time Cr of the refrigerating compartment fan 44 is counted by the timer included in the control unit 120. It is then determined at step S97 whether or not the counted drive time Cr of the refrigerating compartment fan 44 is more than a sampling time Δt (a reference time (about 10 minutes) required to determine a variation in the internal temperature of the refrigerating compartment 24 during the rapid refrigerating operation).

When the counted drive time Cr of the refrigerating compartment fan 44 is determined at step S97 as being more than the sampling time Δt (namely, if YES), the procedure proceeds to step S98. At this step, the refrigerating compartment temperature sensing unit 112 senses the internal temperature Tr of the refrigerating compartment 24 and sends the resultant data to the control unit 120. Thereafter, the procedure proceeds to step S99 to determine whether or not the refrigerating compartment 24 should be defrosted, that is, whether or not the refrigerating compartment 24 is under the defrost requiring condition. For this determination, the drive time Cr of the refrigerating compartment fan 44 counted during the rapid refrigerating operation and the drive time of the refrigerating compartment fan 44 counted during the normal mode operation are accumulated. it is then determined whether or not the accumulated drive time is more than a predetermined time corresponding to the drive time causing the refrigerating compartment evaporator 40 to be frosted.

Where the refrigerating compartment 24 is determined at step S99 as being under the defrost requiring condition (namely, if YES), step S100 is executed. At step S100, it is determined whether or not the drive time Cr of the refrigerating compartment fan 44 counted during the rapid refrigerating operation is more than a predetermined time (for example, about 20 minutes or above).

The reason for determining whether or not the predetermined time has elapsed is because at least two sampling data are required upon calculating a temperature drop gradient Ta corresponding the variation in the internal temperature of the refrigerating compartment 24 on the basis of the internal temperature Tr of the refrigerating compartment 24 sensed for each sampling time Δt so that the calculated temperature drop gradient Ta can be accurate.

When it is determined at step S100 that the predetermined time has not elapsed yet (namely, if NO), the procedure returns to step S96. The procedure from step S96 is then repeatedly executed. When the predetermined time has elapsed (namely, if YES), the procedure proceeds to step S101. Since the variation in the internal temperature of the refrigerating compartment 24 can be accurately calculated in this case, the temperature drop gradient Ta corresponding to the variation of the refrigerating compartment's temperature during the rapid refrigerating operation till the current time point is calculated at step 101.

Assuming that 50 minutes elapsed from the beginning of the rapid refrigerating operation, the number of data about sensed internal temperature is five because the sampling time Δ is about 10 minutes in the above case.

Accordingly, the temperature drop gradient Ta is calculated by deriving the absolute value of the difference between the internal temperature data T5 at the point of time when 50 minutes elapsed from the beginning of the rapid refrigerating operation and the internal temperature data T0 at the point of time when the rapid refrigerating operation begins, and then dividing the derived absolute value by the number of sampling times, namely, 5, as expressed by the following equation (1):

$$Ta=(T5-T0)/5 \quad (1)$$

After calculating the temperature drop gradient Ta as above, the procedure proceeds to step S102 of FIG. 9B. At step S102, it is determined whether or not the temperature drop gradient Ta is larger than a reference gradient Tas stored in the control unit 120. Where the temperature drop gradient Ta is larger than the reference gradient Tas (namely, if YES), the procedure returns to step S95 because the internal temperature Tr of the refrigerating compartment 24 is being normally lowered during the rapid refrigerating operation. The procedure from step S95 is then repeated. On the other hand, when the temperature drop gradient Ta is determined at step S102 as not being larger than the reference gradient Tas (namely, if NO), it is determined that the refrigerating compartment evaporator 40 has been frosted because the internal temperature Tr of the refrigerating compartment 24 is being abnormally lowered during the rapid refrigerating operation. In this case, the procedure proceeds to step S103. At this step, it is determined whether or not the drive time Cr of the refrigerating compartment fan 44 counted by the timer included in the control unit 120 is more than a predetermined time Crs (a predetermined rapid refrigerating time of, for example, about 2 hours) stored in the control unit 120.

When the drive time Cr of the refrigerating compartment fan 44 is determined at step S103 as being less than the predetermined time Crs (namely, if NO), the procedure returns to step S95. The procedure from step S95 is then repeated. When the drive time Cr of the refrigerating compartment fan 44 is determined at step S103 as being more than the predetermined time Crs (namely, if YES), the procedure returns to step S104. At this step, the control unit 120 applies a control signal for stopping the rapid refrigerating operation for the refrigerating compartment 24 to both the compressor driving unit 150 and the refrigerating compartment fan motor driving unit 162 of the fan motor driving unit 160.

Based on the control signal from the control unit 120, the compressor driving unit 150 and refrigerating compartment fan motor driving unit 162 stop the compressor 56 and refrigerating compartment fan motor 42, respectively. As a result, the rapid refrigerating operation for the refrigerating compartment 24 is completed.

Thereafter, the procedure returns to step S105. At this step S105, the control unit 120 applies a control signal to the refrigerating compartment heater driving unit 132 of the heater driving unit 130 in order to execute the defrosting operation for removing frost formed on the refrigerating compartment evaporator 40.

Based on the control signal from the control unit 120, the refrigerating compartment heater driving unit 132 drives the refrigerating compartment evaporator's heater 47. Accordingly, the frost formed on the refrigerating compartment evaporator 40 is removed.

While the refrigerating compartment evaporator's heater 47 is generating heat, the temperature of the refrigerant passing through the refrigerating compartment evaporator 40, that is, the conduit temperature P2 of the refrigerating compartment evaporator 40 is sensed by the refrigerating compartment conduit temperature sensing unit 142 of the conduit temperature sensing unit 140. The resultant data from the refrigerating compartment conduit temperature sensing unit 142 is then sent to the control unit 120. This procedure is executed at step S106. At step S107, the control unit 120 then determines whether or not the conduit temperature P2 of the refrigerating compartment evaporator 40 is higher than a predetermined temperature Ps (namely, a defrosting ending temperature) stored in the control unit 120. When the conduit temperature P2 of the refrigerating compartment evaporator 40 is lower than the predetermined temperature Ps (namely, if NO), it is determined that the frost on the refrigerating compartment evaporator 40 has been incompletely removed. In this case, the procedure returns to step S105. The procedure from step S105 is repeatedly executed until the conduit temperature P2 of the refrigerating compartment evaporator 40 reaches the predetermined temperature Ps.

On the other hand, when the conduit temperature P2 of the refrigerating compartment evaporator 40 is determined at step S107 as being higher than the predetermined temperature Ps (namely, if YES), it is determined that the frost on the refrigerating compartment evaporator 40 has been completely removed. In this case, the procedure proceeds to step S108. At step S108, the control unit 120 sends a control signal to the refrigerating compartment heater driving unit 132 of the heater driving unit 130 in order to stop the generation of heat from the refrigerating compartment evaporator's heater 47.

Based on the control signal from the control unit 120, the refrigerating compartment heater driving unit 132 stops the driving of the refrigerating compartment evaporator's heater 47, thereby stopping the defrosting operation of the refrigerating compartment evaporator 40.

Thereafter, it is determined at step S109 whether or not a predetermined pause time (namely, a predetermined delay time (for example, about 10 minutes) for protecting the compressor 56) has elapsed after the defrosting operation for the refrigerating compartment 24. Where the predetermined pause time has not elapsed yet (namely, if NO), the procedure from step S109 is repeated until the predetermined pause time elapses.

Where the predetermined pause time has elapsed (namely, if YES), the compressor 56 can be driven again. In this case, the compressor 56 is not damaged because it paused sufficiently. Accordingly, the control unit 120 stops the defrosting operation for the refrigerating compartment 24.

On the other hand, when the refrigerating compartment 24 is determined at step S99 as not being under the defrost requiring condition (namely, if NO), step S111 is executed. At step S111, it is determined whether or not the drive time Cr of the refrigerating compartment fan 44 counted during the rapid refrigerating operation is more than the predetermined time Crs (namely, the predetermined rapid refrigerating time of about 2 hours) stored in the control unit 120.

When the drive time Cr of the refrigerating compartment fan 44 is determined at step S111 as being less than the predetermined time Crs (namely, if NO), the procedure returns to step S95. The procedure from step S95 is then repeated. When the drive time Cr of the refrigerating compartment fan 44 is determined at step S111 as being more than the predetermined time Crs (namely, if YES), the procedure proceeds to step S112. At this step, the control unit 120 applies a control signal for stopping the rapid refrigerating operation for the refrigerating compartment 24 to both the compressor driving unit 150 and the refrigerating compartment fan motor driving unit 162 of the fan motor driving unit 160.

Based on the control signal from the control unit 120, the compressor driving unit 150 and refrigerating compartment fan motor driving unit 162 stop the compressor 56 and refrigerating compartment fan motor 42, respectively. As a result, the rapid refrigerating operation for the refrigerating compartment 24 is completed.

Although the fourth embodiment of the present invention has been described in conjunction with the rapid refrigerating operation for the refrigerating compartment 24, it may be similarly implemented for the rapid freezing operation for the freezing compartment 22.

Industrial Applicability

As apparent from the above description, the present invention provides a defrosting apparatus for a refrigerator and a method for controlling the defrosting apparatus, wherein the refrigerating compartment is cooled irrespective of the internal temperature of the freezing compartment when the internal temperature of the refrigerating compartment is higher than a predetermined temperature, so that the refrigerating compartment is maintained below the predetermined temperature. In accordance with the present invention, the defrosting operation is carried out in accordance with the drive times of the compressor and refrigerating compartment fan when the internal temperature of the refrigerating compartment is higher than the predetermined temperature even though the compressor and refrigerating compartment fan are continuously driven. Accordingly, it is possible to improve the cooling efficiency. In accordance with the present invention, the point of time when the defrosting operation begins is determined on the basis of the drive times of the compressor and refrigerating compartment fan and the variable environmental condition. Accordingly, the defrosting operation can be efficiently achieved.

Where the defrosting operation for the refrigerating compartment is achieved within a predetermined time under the defrost requiring condition of the freezing compartment, the defrosting operation for the freezing compartment is delayed so that the defrosting operations for the freezing and refrigerating compartments can be simultaneously carried out. On the other hand, where the refrigerating compartment is under the defrost requiring condition, the defrosting operations for the freezing and refrigerating compartments are simultaneously carried out irrespective of the defrost requiring condition of the freezing compartment. In this case, the refrigerating efficiency is improved.

For the rapid refrigerating operation, the point of time when the defrosting operation for the refrigerating compartment begins is accurately determined by calculating a temperature drop gradient on the basis of a variation in the internal temperature of the refrigerating compartment. For the rapid freezing operation, the point of time when the defrosting operation for the freezing compartment begins is accurately determined by calculating a temperature drop gradient on the basis of a variation in the internal temperature of the freezing compartment. In either case, accordingly, it is possible to efficiently achieve the defrosting operation.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

We claim:

1. An apparatus for defrosting a refrigerator, comprising:

a refrigerating compartment for storing food to be refrigerated;

a freezing compartment adapted to store food to be frozen, the freezing compartment being defined above the refrigerating compartment by an intermediate partition member;

a compressor adapted to compress a refrigerant to that of high temperature and pressure under a control of compressor driving means;

a pair of heat exchanging means respectively associated with the freezing and refrigerating compartments and adapted to heat-exchange flows of air, being blown into the freezing and refrigerating compartments, with the refrigerant, thereby cooling the air flows;

a pair of fan means respectively associated with the freezing and refrigerating compartments and adapted to supply the cold air flows heat-exchanged with the heat exchanging means to the freezing and refrigerating compartments under a control of fan motor driving means;

a pair of heating means respectively associated with, the freezing and refrigerating compartments and adapted to defrost the freezing and refrigerating compartment heat exchanging means under a control of heater driving means;

temperature sensing means adapted to sense respective internal temperatures of the freezing and refrigerating compartments;

temperature setting means adapted to set respective desired temperatures of the freezing and refrigerating compartments, the temperature setting means also setting a rapid freezing operation and a rapid refrigerating operation;

control means adapted to determine the point of time when a defrosting operation for each heat exchanging means begins on the basis of a drive time of the compressor and respective drive times of the freezing and refrigerating compartment fan means; and conduit temperature sensing means adapted to sense respective conduit temperatures of the freezing and refrigerating compartment heat exchanging means during respective heat generating operations of the freezing and refrigerating compartment heating means.

2. The apparatus in accordance with claim 1, wherein the freezing and refrigerating compartment heat exchanging means are a freezing compartment evaporator and a refrigerating compartment evaporator installed at the freezing and refrigerating compartments, respectively.

3. The apparatus in accordance with claim 1, wherein the freezing and refrigerating compartment fan means are a freezing compartment fan and a refrigerating compartment fan coupled to rotating shafts of freezing and refrigerating compartment fan motors, respectively.

4. A method for controlling a defrosting operation of a refrigerator, comprising:

drive time calculating step of calculating a drive time of a compressor and respective drive times of freezing and refrigerating compartment fan means;

defrost requiring condition determining step of determining respective defrost requiring conditions of freezing and refrigerating compartment evaporators on the basis of the drive time of the compressor and the drive times of the freezing and refrigerating compartment fan means all calculated at the drive time calculating step;

defrosting operation step of executing a defrosting operation for removing frost formed on the freezing and refrigerating compartment evaporators in accordance with the defrost requiring conditions of the freezing and refrigerating compartment evaporators determined at the defrost requiring condition determining step; and defrosting and determining step of sensing respective conduit temperatures of the freezing and refrigerating compartment evaporators being varied during the defrosting operation executed at the defrosting operation step, and determining whether or not the frost on the freezing and refrigerating compartment evaporators has been completely removed on the basis of the sensed conduit temperatures.

5. The method in accordance with claim 4, wherein the defrost requiring condition determining step comprises the steps of determining the defrost requiring condition of the freezing compartment evaporator on the basis of at least one of the drive time of the compressor and the drive time of the freezing compartment fan means, and determining the defrost requiring condition of the refrigerating compartment evaporator on the drive time of the refrigerating compartment fan means when the freezing compartment evaporator is determined as being under the defrost requiring condition.

6. The method in accordance with claim 4, wherein the defrosting operation step comprises the step of simultaneously executing the defrosting operations for removing frost formed on the freezing and refrigerating compartment evaporators when the drive times of the freezing and refrigerating compartment fan means are more than predetermined times respectively stored in the control means in association with the freezing and refrigerating compartment fan means.

7. The method in accordance with claim 4, wherein the defrosting operation step comprises the step of executing the defrosting operation for removing frost formed only on the freezing compartment evaporator when the drive time of the refrigerating compartment fan means is less than a predetermined time stored in the control means in association with the freezing and refrigerating compartment fan means.

* * * * *